US012268341B2

(12) United States Patent
Osborne, Jr.

(10) Patent No.: US 12,268,341 B2
(45) Date of Patent: Apr. 8, 2025

(54) SHEET MATERIAL DISPENSING ASSEMBLY WITH INTEGRATED GEAR CLUTCH

(71) Applicant: Charles Agnew Osborne, Jr., Cumming, GA (US)

(72) Inventor: Charles Agnew Osborne, Jr., Cumming, GA (US)

( * ) Notice: Subject to any disclaimer, the term of this patent is extended or adjusted under 35 U.S.C. 154(b) by 53 days.

(21) Appl. No.: 17/138,196

(22) Filed: Dec. 30, 2020

(65) Prior Publication Data

US 2021/0113033 A1 Apr. 22, 2021

Related U.S. Application Data

(63) Continuation-in-part of application No. 16/593,004, filed on Oct. 4, 2019, now Pat. No. 11,154,166, and (Continued)

(51) Int. Cl.
*A47K 10/36* (2006.01)
*A47K 10/42* (2006.01)

(52) U.S. Cl.
CPC ..... *A47K 10/3618* (2013.01); *A47K 10/424* (2013.01)

(58) Field of Classification Search
CPC ..... Y10T 83/896; Y10T 83/4812; Y10T 225/205; Y10T 225/393; A47K 10/36; A47K 10/3631; A47K 10/3637; A47K 10/3643; A47K 10/3656; A47K 2010/365; B65H 16/005; B65H 35/00; (Continued)

(56) References Cited

U.S. PATENT DOCUMENTS 2,738,934 A 3/1956 Dobkin
3,317,150 A 5/1967 Summersby
(Continued)

FOREIGN PATENT DOCUMENTS

CN 104703521 A 6/2015
EP 0378550 B1 9/1994
(Continued)

OTHER PUBLICATIONS

Fast Eddy Bearings, 6x33 10x33 12 One Way Bearing HF0612, obtained from https://www.fasteddybearings.com/6×10×12-one-way-bearing-hf0612/?utm_source=google&utm_medium=shopping&utm_content=2037&utm_campaign=FastEddy%20Bearings&gclid=EAlalQobChMI78OE1tGK-wIVA7_ICh1IGgHCEAQYBSABEglxO_D_BWE on Oct. 31, 2022 (Year: 2014).*
(Continued)

*Primary Examiner* — Evan H MacFarlane
(74) *Attorney, Agent, or Firm* — Womble Bond Dickinson (US) LLP

(57) ABSTRACT

'In example, a sheet material dispenser can include a feed roller configured to engage and move the sheet material along a discharge path for dispensing thereof, and a manual dispensing assembly in communication with the feed roller. The manual dispensing assembly can include an engagement portion operatively coupled to the feed roller body for engagement by a user to rotate the feed roller to facilitate dispensing of the sheet material, and an integrated gear clutch configured to control movement of the engagement portion or the feed roller. Other examples also are described.

13 Claims, 24 Drawing Sheets

Related U.S. Application Data a continuation-in-part of application No. 15/988,579, filed on May 24, 2018, now Pat. No. 11,109,722.

(60) Provisional application No. 62/956,789, filed on Jan. 3, 2020, provisional application No. 62/741,350, filed on Oct. 4, 2018.

(58) Field of Classification Search
CPC ..... B65H 35/0006; B65H 35/006; B65H 35/0066; B65H 35/0073; B65H 35/008; B65H 35/0086; B65H 35/04; B65H 35/06; B65H 35/08; B65H 2701/1924; B65H 16/10; B65H 16/103; B65H 16/106
See application file for complete search history.

(56) References Cited

U.S. PATENT DOCUMENTS 3,554,456 A 1/1971 Moore
3,843,218 A * 10/1974 Krueger ..... A47K 10/3687 312/34.19
3,892,368 A 7/1975 Ricards
3,893,636 A 7/1975 Wise et al.
4,003,525 A 1/1977 Podvin et al.
4,071,200 A 1/1978 Stone
4,192,442 A 3/1980 Bastian et al.
4,635,837 A 1/1987 Granger
4,690,344 A 9/1987 Yokota
4,712,461 A 12/1987 Rasmussen
4,738,176 A 4/1988 Cassia
4,790,490 A 12/1988 Chakravorty
4,846,035 A 7/1989 Granger
5,048,386 A 9/1991 DeLuca et al.
5,060,877 A 10/1991 Bullivant
5,441,210 A 8/1995 Hinton
5,452,832 A 9/1995 Niada
5,672,206 A 9/1997 Gorman
5,772,291 A 6/1998 Bryd et al.
5,848,609 A 12/1998 Marchesseault et al.
6,079,305 A 6/2000 Bloch et al.
6,098,917 A 8/2000 Cruz
6,179,243 B1 1/2001 Granger
6,196,102 B1 3/2001 Granger
6,199,792 B1 3/2001 Mivelaz
6,283,139 B1 9/2001 Symonds
6,314,850 B1 11/2001 Morand
6,378,725 B1 4/2002 Granger
6,408,727 B1 6/2002 Harris et al.
6,411,920 B1 6/2002 McConnell
6,532,979 B1 3/2003 Richter
6,553,879 B2 4/2003 Morand
6,691,945 B2 2/2004 Slezak
6,695,246 B1 2/2004 Elliott et al.
6,715,730 B2 4/2004 Ehr
6,820,785 B2 11/2004 Kapiloff
6,826,985 B2 12/2004 Broehl
6,834,825 B2 12/2004 Pollastrelli et al.
6,892,620 B2 5/2005 Kapiloff
6,892,746 B2 5/2005 Ford
6,895,848 B1 5/2005 Svensson
6,903,654 B2 6/2005 Hansen et al.
6,977,588 B2 12/2005 Schotz et al.
6,988,689 B2 1/2006 Thomas et al.
7,147,204 B2 12/2006 Hollingsworth
7,213,782 B2 5/2007 Osborne et al.
7,296,765 B2 11/2007 Rodrian
7,357,348 B2 4/2008 Kananen
7,370,824 B1 5/2008 Osborne
7,373,864 B2 5/2008 Granger
7,460,013 B1 12/2008 Osborne et al.
7,527,215 B1 5/2009 Siddiqui
7,571,670 B2 8/2009 Formon
7,637,452 B2 12/2009 Kanbar et al.
7,946,522 B2 5/2011 Lewis et al.
7,987,756 B2 8/2011 Lewis et al.
8,082,827 B2 12/2011 Friesen et al.
8,146,471 B2 4/2012 Hansen et al.
8,167,228 B2 5/2012 Kobayashi et al.
8,297,160 B2 10/2012 Friesen et al.
8,353,475 B2 1/2013 Kobayashi et al.
8,382,026 B2 2/2013 Keily et al.
8,402,872 B2 3/2013 Friesen et al.
8,424,431 B1 4/2013 Jackman et al.
8,528,851 B2 9/2013 Friesen et al.
8,555,761 B2 10/2013 Keily et al.
8,578,826 B2 11/2013 Hansen et al.
8,651,003 B1 2/2014 Vercellone
8,733,218 B2 5/2014 Hansen et al.
8,800,415 B2 8/2014 Osborne
8,919,233 B2 12/2014 Lewis et al.
8,943,938 B2 2/2015 Sahlberg
9,010,602 B2 4/2015 Budz et al.
9,032,850 B2 5/2015 Chiba et al.
9,701,508 B2 7/2017 Diamond
9,756,992 B2 9/2017 Osborne
9,907,441 B2 3/2018 Osborne et al.
10,123,665 B2 11/2018 Osborne et al.
10,136,769 B2 11/2018 Osborne et al.
10,441,117 B2 10/2019 Osborne, Jr.
10,610,064 B2 4/2020 Osborne et al.
10,660,486 B2 5/2020 Osborne, Jr.
10,835,086 B2 11/2020 Osborne et al.
2001/0045149 A1 11/2001 Granger
2002/0073819 A1 6/2002 Phelps et al.
2003/0019899 A1 1/2003 Chen
2004/0188486 A1 9/2004 Granger
2005/0051008 A1 3/2005 Granger
2005/0145745 A1 7/2005 Lewis et al.
2005/0167541 A1 8/2005 Osborne
2006/0037449 A1 2/2006 Lavallee
2006/0236832 A1 10/2006 Cvjetkovic et al.
2007/0079684 A1 4/2007 Friesen et al.
2007/0176041 A1 8/2007 Friesen et al.
2007/0194166 A1 8/2007 Reinsel et al.
2007/0215743 A1 9/2007 Granger
2008/0128448 A1 6/2008 Cittadino
2008/0217350 A1 9/2008 Hansen et al.
2009/0057478 A1 3/2009 Connor
2009/0140001 A1 6/2009 Lewis et al.
2009/0256022 A1 10/2009 Maurer
2010/0102101 A1 4/2010 Keily et al.
2010/0243696 A1 9/2010 Friesen et al.
2010/0286817 A1 11/2010 Goeking
2010/0319508 A1 12/2010 Hagleitner
2011/0068129 A1 3/2011 Maurer
2011/0133019 A1 6/2011 Keily et al.
2011/0233318 A1 9/2011 Anderson
2012/0085857 A1 4/2012 Vienneau et al.
2012/0138654 A1* 6/2012 Lee ..... A47K 10/3827 225/39
2012/0167739 A1 7/2012 Lewis et al.
2012/0182366 A1 7/2012 Kobayashi et al.
2012/0312853 A1 12/2012 Osborne et al.
2013/0105614 A1* 5/2013 Hjort ..... A47K 10/36 242/564.5
2013/0192437 A1 8/2013 Sahlberg
2013/0320130 A1 12/2013 Osborne
2014/0054410 A1 2/2014 Achton
2014/0263812 A1 9/2014 Osborne
2014/0312158 A1 10/2014 Hluschenko et al.
2015/0083846 A1 3/2015 Budz et al.
2015/0216376 A1 8/2015 Keily et al.
2015/0297043 A1 10/2015 Osborne et al.
2016/0353945 A1 12/2016 Osborne
2016/0353946 A1 12/2016 Osborne
2016/0353947 A1 12/2016 Osborne
2017/0188760 A1 7/2017 Henson et al.
2017/0367547 A1 12/2017 Osborne
2017/0369262 A1 12/2017 Green
2018/0153360 A1 6/2018 Osborne, Jr. et al.
2018/0170703 A1 6/2018 Osborne, Jr.
2018/0263433 A1 9/2018 Osborne, Jr.
2019/0216270 A1 7/2019 Osborne, Jr.
2020/0029751 A1 1/2020 Osborne, Jr.

(56) References Cited

U.S. PATENT DOCUMENTS

| | | | |
|---|---|---|---|
| 2020/0054177 | A1 | 2/2020 | Osborne, Jr. |
| 2020/0163498 | A1 | 5/2020 | Osborne, Jr. |
| 2020/0189869 | A1 | 6/2020 | Osborne, Jr. |
| 2020/0205620 | A1 | 7/2020 | Osborne, Jr. |
| 2020/0205621 | A1 | 7/2020 | Osborne, Jr. |
| 2020/0229659 | A1 | 7/2020 | Osborne, Jr. |
| 2020/0390295 | A1 | 12/2020 | Osborne, Jr. |

FOREIGN PATENT DOCUMENTS

| | | | |
|---|---|---|---|
| JP | 2002-515273 | A | 5/2002 |
| KR | 10-1197415 | B1 | 11/2012 |
| WO | WO 03/053202 | A1 | 7/2003 |
| WO | WO2013/059040 | A1 | 4/2013 |
| WO | WO2018/126236 | A1 | 7/2018 |

OTHER PUBLICATIONS

Koyo, 30×37×30mm Clutch Drawn Cup Needle Bearing, obtained from https://www.mscdirect.com/product/details/19391283 on Oct. 31, 2022.*

International Search Report and the Written Opinion of the International Searching Authority for PCT/US2020/067516, mailed Apr. 9, 2021.

Extended European Search Report regarding related Application No. 20910570.9 dated Jan. 2, 2024.

* cited by examiner

SHEET MATERIAL DISPENSING ASSEMBLY WITH INTEGRATED GEAR CLUTCH

CROSS REFERENCE TO RELATED APPLICATIONS

The present application claims the benefit of U.S. Provisional Patent Application No. 62/956,789, filed Jan. 3, 2020. The present application further is a continuation-in-part of U.S. patent application Ser. No. 16/593,004, filed Oct. 4, 2019, which claims the benefit of U.S. Provisional Application 62/741,350, filed Oct. 4, 2018, and which is a continuation-in-part of U.S. patent application Ser. No. 15/988,579, filed May 24, 2018,

INCORPORATION BY REFERENCE

The disclosures of U.S. Provisional Patent Application No. 62/956,789, filed Jan. 3, 2020; U.S. patent application Ser. No. 16/593,004, filed Oct. 4, 2019; U.S. patent application Ser. No. 15/988,579, filed May 24, 2018; and U.S. Provisional Patent Application No. 62/741,350, filed Oct. 4, 2018, are hereby incorporated by reference herein for all purposes as if presented in their entireties.

TECHNICAL FIELD

This disclosure generally relates to dispensers and, more particularly, to dispensers for flexible sheet materials, such as paper towels, tissues, or other paper products.

BACKGROUND

Different types of devices for dispensing selected quantities of flexible sheet products, such as for use in restrooms, hospitals and/or other environments, have been developed in recent years. Some of these dispensers include manual dispensing mechanisms, such as knobs, levers, etc., that are configured to be activated by users for manually dispensing desired amounts of sheet material from the dispensers.

Often times, however, users may misuse or tamper with these manual dispensing mechanisms. That is, users may rotate or otherwise move the manual dispensing mechanisms in undesired ways, and this may result in jamming or other malfunctioning of the dispenser and/or damage to or unnecessary wear of components thereof.

Accordingly, it can be seen that a need exists for manual dispensing mechanisms that inhibit, limit, or prevent undesired movement thereof to help to prevent jamming or other malfunctioning and/or damage, wear, etc. of such dispensers and/or associated components. The present disclosure addresses the foregoing and other related and unrelated problems or issues in the art.

SUMMARY

Briefly described, in one aspect, the present disclosure includes a sheet material dispenser or dispenser assembly configured for dispensing desired or selected amounts of sheet material. In some embodiments, the sheet material dispenser can include a dispenser housing that is configured to support one or more supplies of sheet material therealong and that has a discharge (e.g., discharge chute, opening, etc.) for dispensing of the selected amounts of sheet material therefrom.

The feed roller includes a feed roller body configured to engage and move sheet material from the one or more supplies of sheet material along a discharge path or path of travel and out from the discharge for dispensing of the selected amounts of sheet material upon activation (i.e., rotation) of the feed roller.

The sheet material dispenser assembly can include at least one pressing roller rotatably mounted along the feed roller body and configured to engage the sheet material therebetween to facilitate feeding of the sheet material along the discharge path upon rotation of the feed roller.

In some aspects, the sheet material dispenser assembly can comprise a manual dispensing assembly that communicates with the feed roller that is rotatably mounted to the dispenser housing and is configured to enable a user to manually activate the feed roller. The manual dispensing assembly includes a user engagement portion or mechanism that is operatively coupled to or otherwise in communication with the feed roller body such that engagement of the user engagement mechanism by a user causes rotation of the feed roller body to facilitate dispensing of the selected amounts of sheet material from the discharge.

In some embodiments, the engagement mechanism can include a knob, lever, handle, etc. or other suitable engagement member that is operatively connected to the feed roller body, such that rotation of the knob, lever, handle, etc. by a user causes rotation of the feed roller body. The engagement mechanism further can include one or more engagement features that facilitate gripping of the engagement mechanism by users for manual dispensing of sheet material.

The manual dispensing assembly further can include a rotating shaft or linkage that connects the engagement mechanism to the feed roller body. For example, one end of the rotating shaft can be connected to the engagement mechanism, such as by snap-fittings, adhesives, fasteners, etc., while an opposing end of the rotating shaft can be connected to the feed roller body, such as by a connection member that is connected to the feed roller body by snap-fittings, adhesives, fasteners, etc.

In addition, the manual dispensing assembly can include an integrated gear clutch that controls or limits movement of the engagement mechanism and/or feed roller. In some aspects, the integrated gear clutch is configured to generally allow for movement of the feed roller and/or the engagement mechanism when the engagement mechanism is moved in one direction, but limit, inhibit, or prevent movement of the feed roller and/or the engagement mechanism when the engagement mechanism is moved in an opposite direction to help to substantially reduce, inhibit, or prevent jamming of the sheet material, damage to or malfunctioning of various components of the sheet material dispenser assembly, and/or unnecessary wearing of various components thereof.

In one embodiment, the integrated gear clutch can be provided along and connected to the rotating shaft to control movement of the engagement mechanism and/or feed roller body. It will, however, also be understood that the integrated gear clutch can be incorporated with various other suitable components of the manual dispensing mechanism without departing from the scope of the present disclosure.

In some embodiments, the integrated gear clutch generally can include an outside ring, an inner elastic bracket, and a plurality of rollers (e.g., cylindrical bearing rollers, ball bearing rollers, etc.). The outside ring generally is configured to house or surround the inner elastic bracket, and the inner elastic bracket is configured to engage or holds the plurality of rollers in spaced series thereabout. The inner elastic bracket further can include a body having openings or apertures defined therein, with each opening being sized, dimensioned, or otherwise configured to receive a respective roller of the plurality of rollers. The inner elastic bracket further can include biased prongs or other biasing members, formed therewith or connected thereto, that are configured to engage and/or support the rollers within their respective openings.

In addition, each opening can define a rotating area along one side thereof and a non-rotating area along an opposing side thereof. The rotating area generally is configured to allow for rotation of the rollers, while the non-rotating area generally is configured to reduce, inhibit, or prevent rotation of the rollers. For example, the rollers generally will move in relation to their respective openings based on the direction of rotation (or direction of attempted rotation) of the rotating shaft between engagement with the rotating area and the non-rotating area. As a result, for rotation in one direction (e.g., a first direction), the rollers will engage the rotating area and rotate or spin, thereby allowing the rotating shaft to freely rotate. Conversely, when rotation in an opposite direction is attempted (e.g., a second direction), the rollers can engage the non-rotating area, which engagement substantially limits, inhibits, or retards rotation of the rollers, and as a result, substantially limits, inhibits, or retards rotation of the rotating shaft. In this regard, the integrated gear clutch can be operable to substantially limit, inhibit, or retard rotation of the engagement mechanism and/or feed roller in at least one direction.

In some embodiments, the non-rotating area can include the biased prongs or members, which prongs can be configured to lock or limit rotation of the rollers upon engagement therewith. The rotating area also can include a surface of the inner elastic bracket defined by/along the openings, which surface can be curved or arcuate and can be generally complementary or correspond to the rollers to generally allow rotation of the rollers.

With the integrated gear clutch received about the rotating shaft, the rollers can engage or contact the rotating shaft. Accordingly, when the engagement mechanism is rotated in one direction (e.g., the first direction), the rollers engage the rotating area and are allowed to rotate, which in turn allows rotation of the rotating shaft and the feed roller body. When the engagement mechanism is rotated in the opposite or opposing direction (e.g., the second direction), however, the rollers engage the non-rotating area, which stops, limits, or inhibits rotation of the rollers, this also prevents rotation of the rotating shaft and the feed roller body due to frictional engagement between the stationary rollers and the rotating shaft sufficient to block or inhibit rotation thereof in the second, opposing direction.

In embodiments, the integrated clutch mechanism can be incorporated with a bearing assembly of the manual dispenser assembly. The bearing assembly can include a bearing that is connected to the dispenser housing and rotatably supports the feed roller body. The bearing assembly further can include a cylindrical body having a passage or cavity that receives the integrated gear clutch. For example, the outer ring of the integrated gear clutch can be press-fitted or otherwise received within the passage of the bearing, such that the outer ring engages an inner surface of the bearing defined by the passage. The rotating shaft of the engagement assembly further can be received within the passage such that the plurality of rollers engages the rotating shaft (e.g., contact an outer surface of the rotating shaft).

The sheet material dispenser assembly additionally can include a cutting mechanism or assembly that also can be integrated with the feed roller and configured to be operable for cutting or perforating the sheet material during dispensing thereof. The cutting assembly can include a cutting blade that is connected to a moveable support that is movable with the feed roller body such that the cutting blade moves in and out from the feed roller body (e.g., in and out from one or more openings defined in the feed roller body) with rotation thereof. The movable support further can include a cam or camming member operatively connected thereto that moves along and engages a cam track configured to facilitate movement of the cutting mechanism in and out from the feed roller body. The cam track can be formed within or along a portion of or otherwise connected to the bearing assembly. For example, the cam track can be formed within a portion of the bearing assembly that is integrally formed with the bearing.

The manual dispenser assembly further can include a feed roller biasing assembly that can assist rotation of the feed roller (and cutting assembly), e.g., when a user rotates the engagement mechanism. The feed roller biasing assembly can include one or more biasing members that are operatively connected to the feed roller to assist rotation thereof. In one construction, the one or more biasing members each can be connected to a linkage that is attached to an interior surface of the feed roller body. The feed roller biasing assembly further can function cooperatively with the integrated gear clutch, whereby as the feed roller biasing assembly facilitates and drives the responsive rotation of the feed roller when the manual dispensing assembly is engaged, the integrated gear clutch can prevent or limit a reverse rotation of the feed roller in an undesired direction, and/or further, over-rotation of the feed roller, to help to prevent malfunctioning of or damage to the feed roller biasing assembly.

These and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the invention and not in limitation thereof, since the scope of the invention is defined by the claims.

Figure 1:
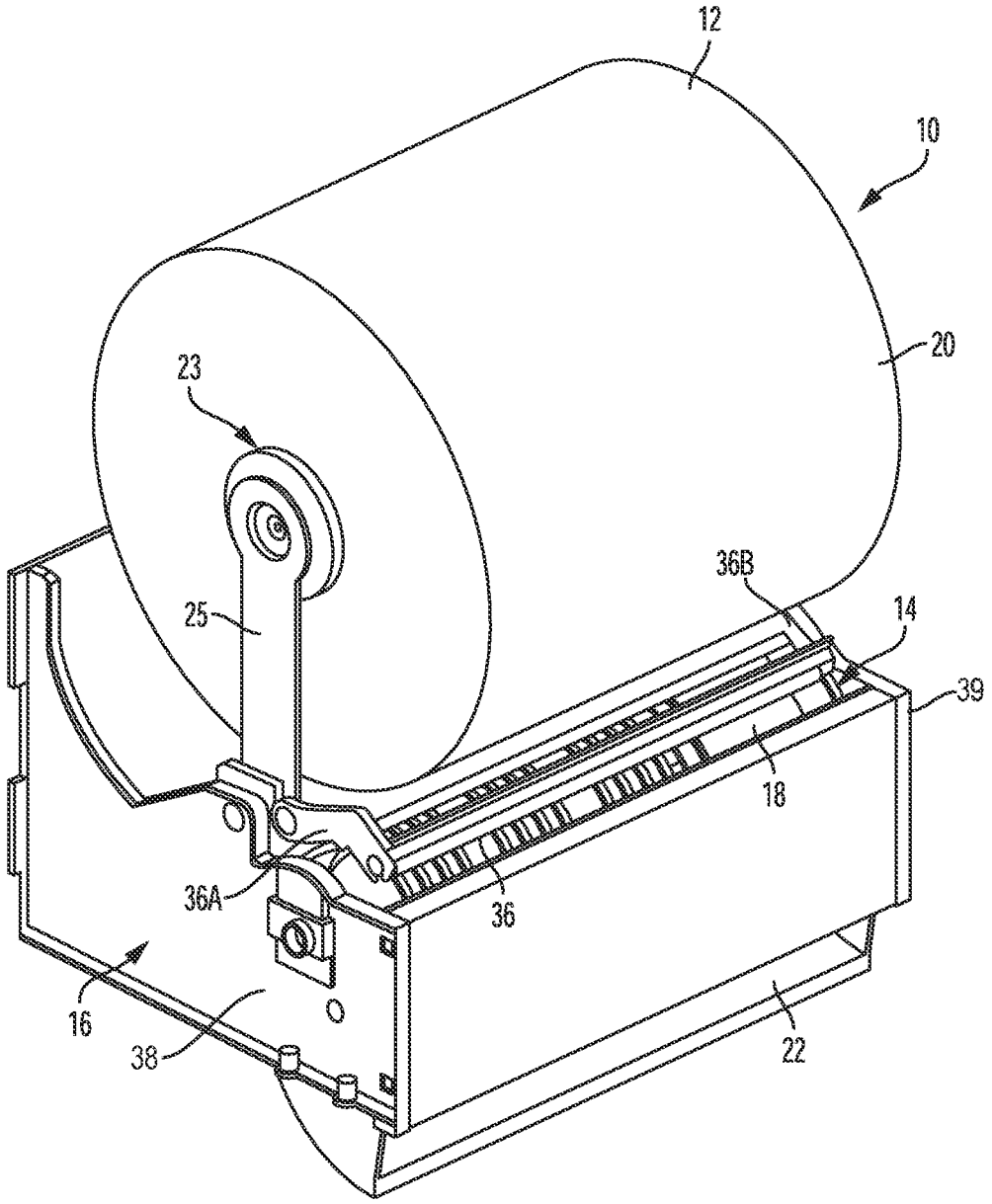
FIG. 1 shows a perspective view of an example sheet material dispenser according to principles of the present disclosure.
Figure 2:
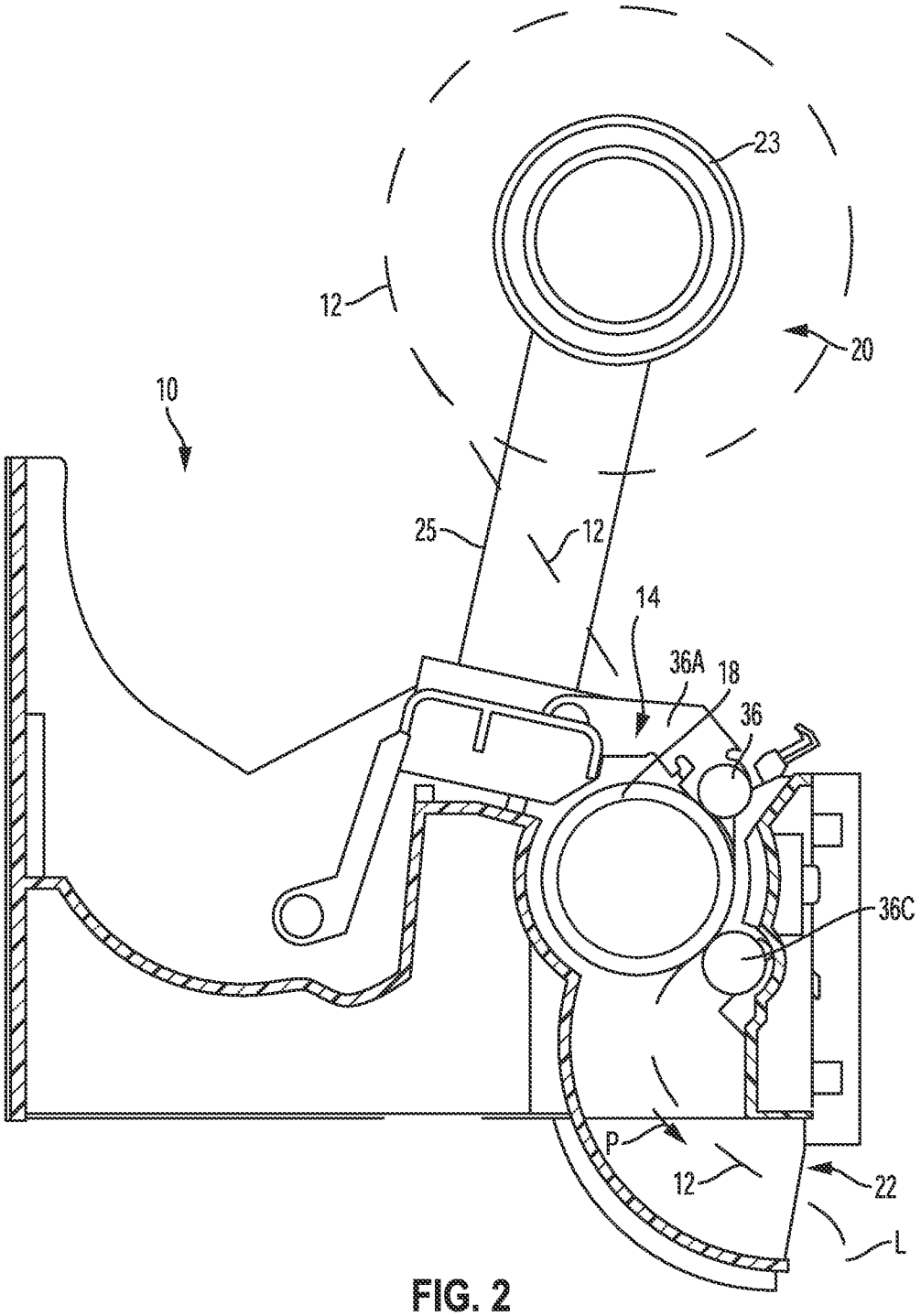
FIG. 2 shows a cross-sectional view of an example dispenser according to principles of this disclosure.
Figure 4A:
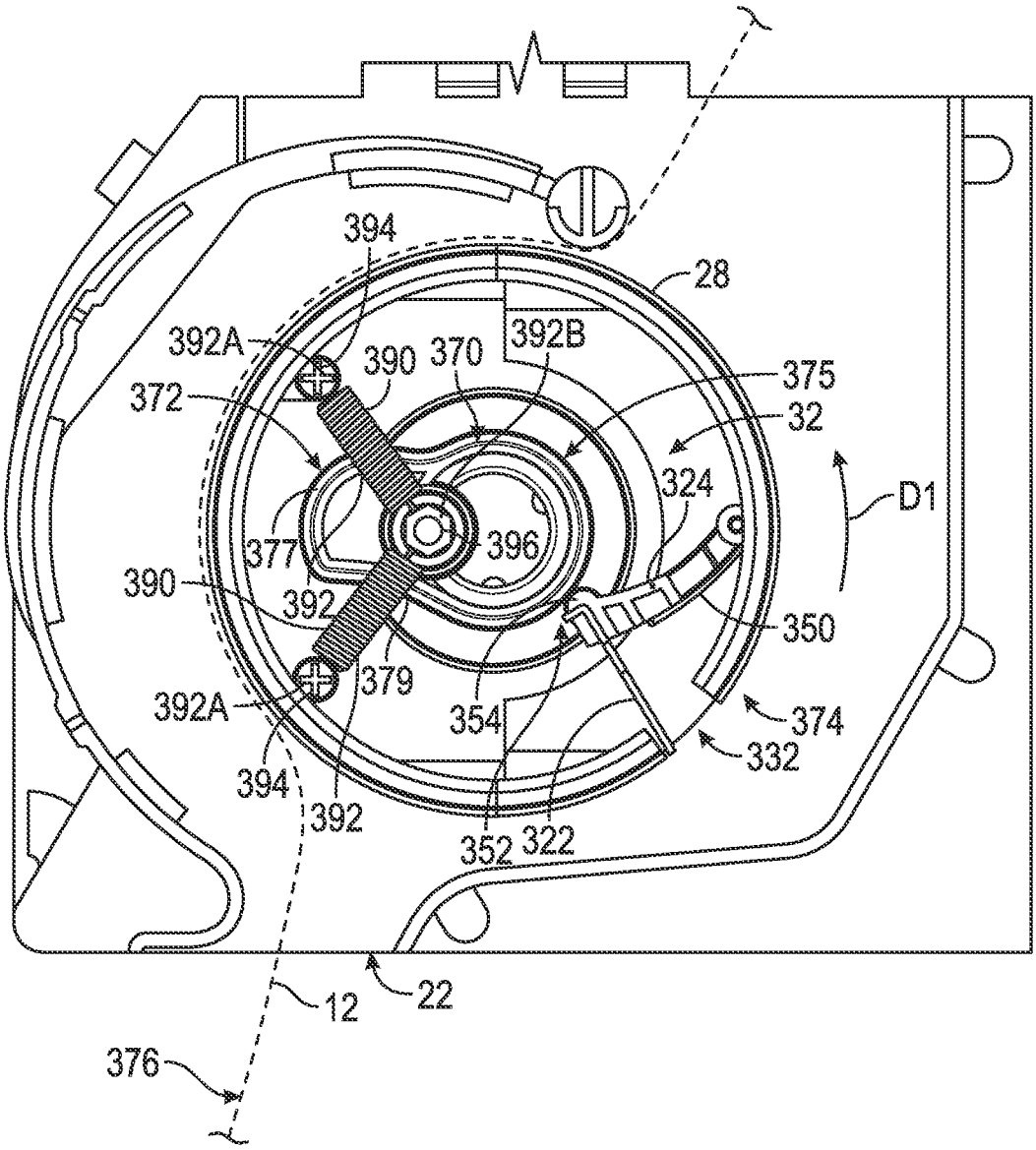
FIGS. 4A, 4B, 4C, 4D, and 4E show cross-sectional views of a feed roller with the cutting system/assembly of FIGS. 3A and 3B.
Figure 4B:
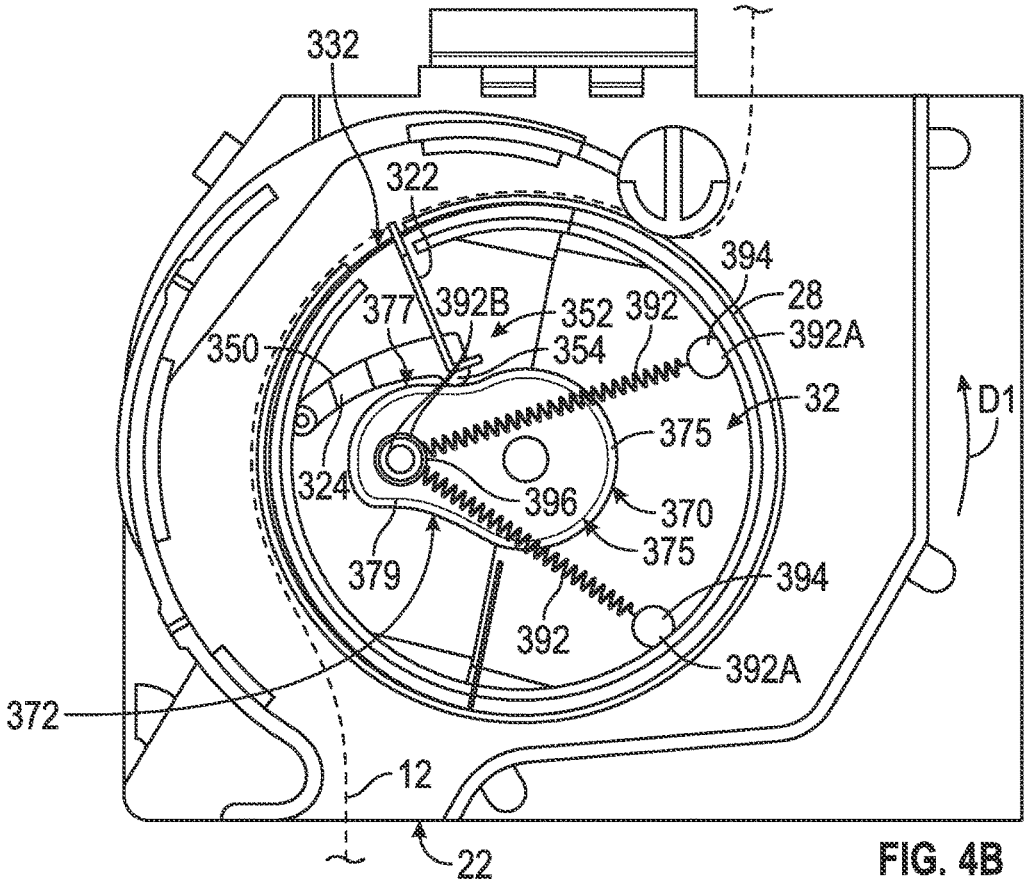
Figure 4C:
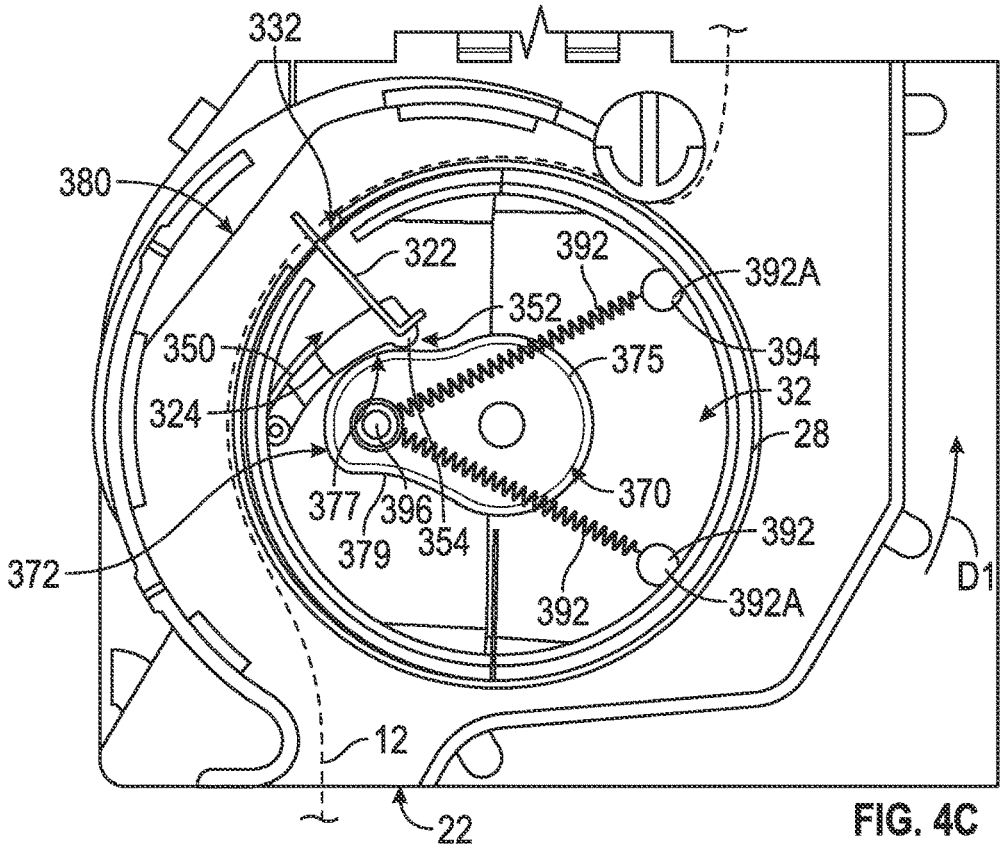
Figure 4D:
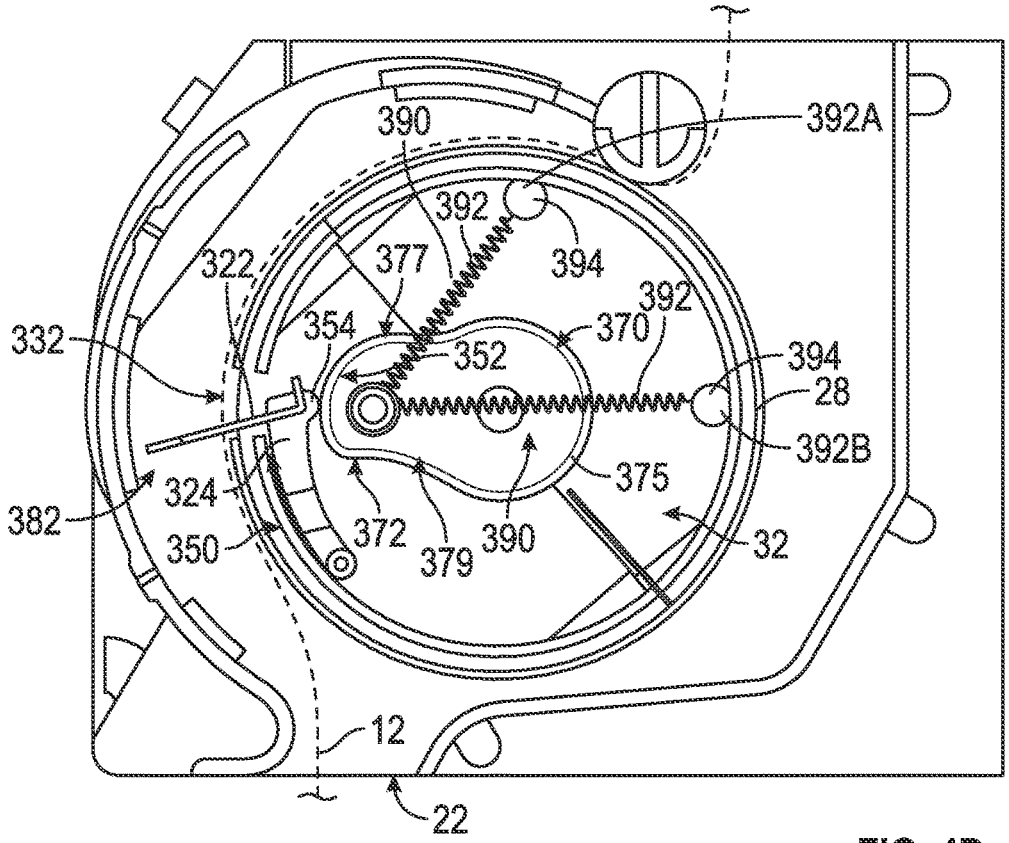
Figure 4E:
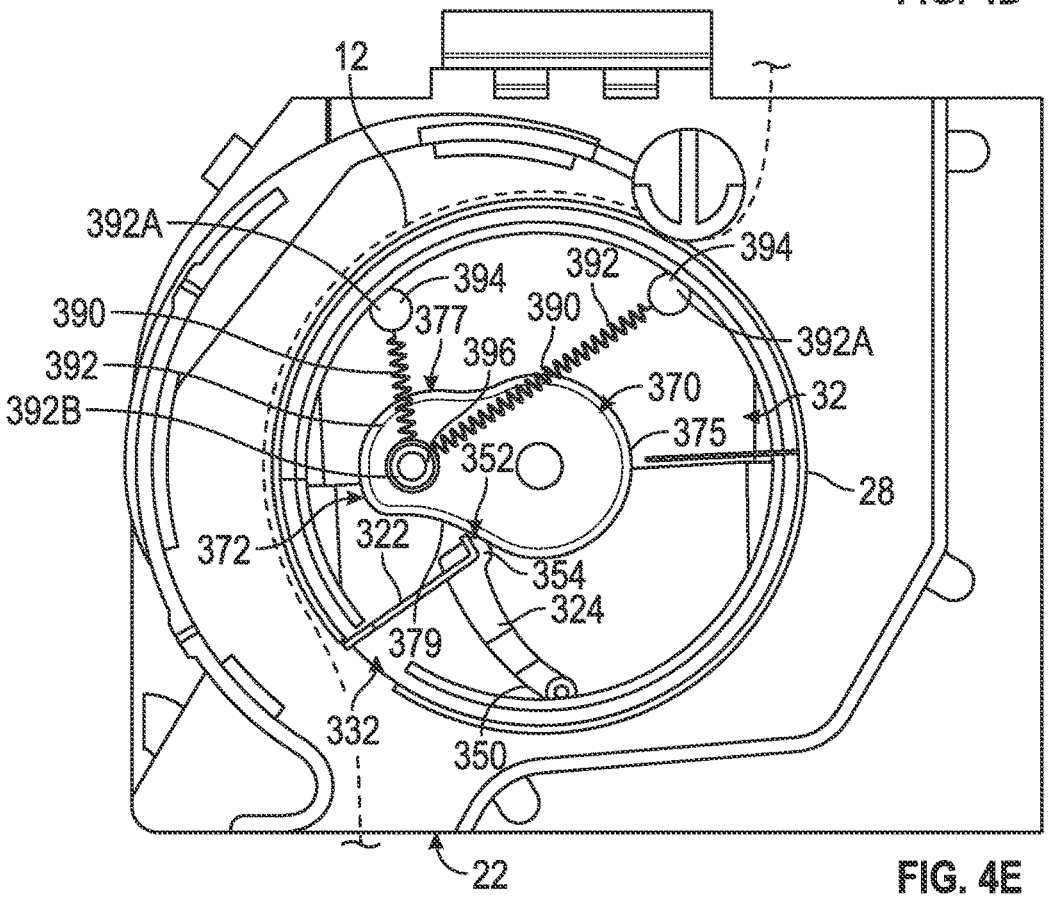
Figure 5:
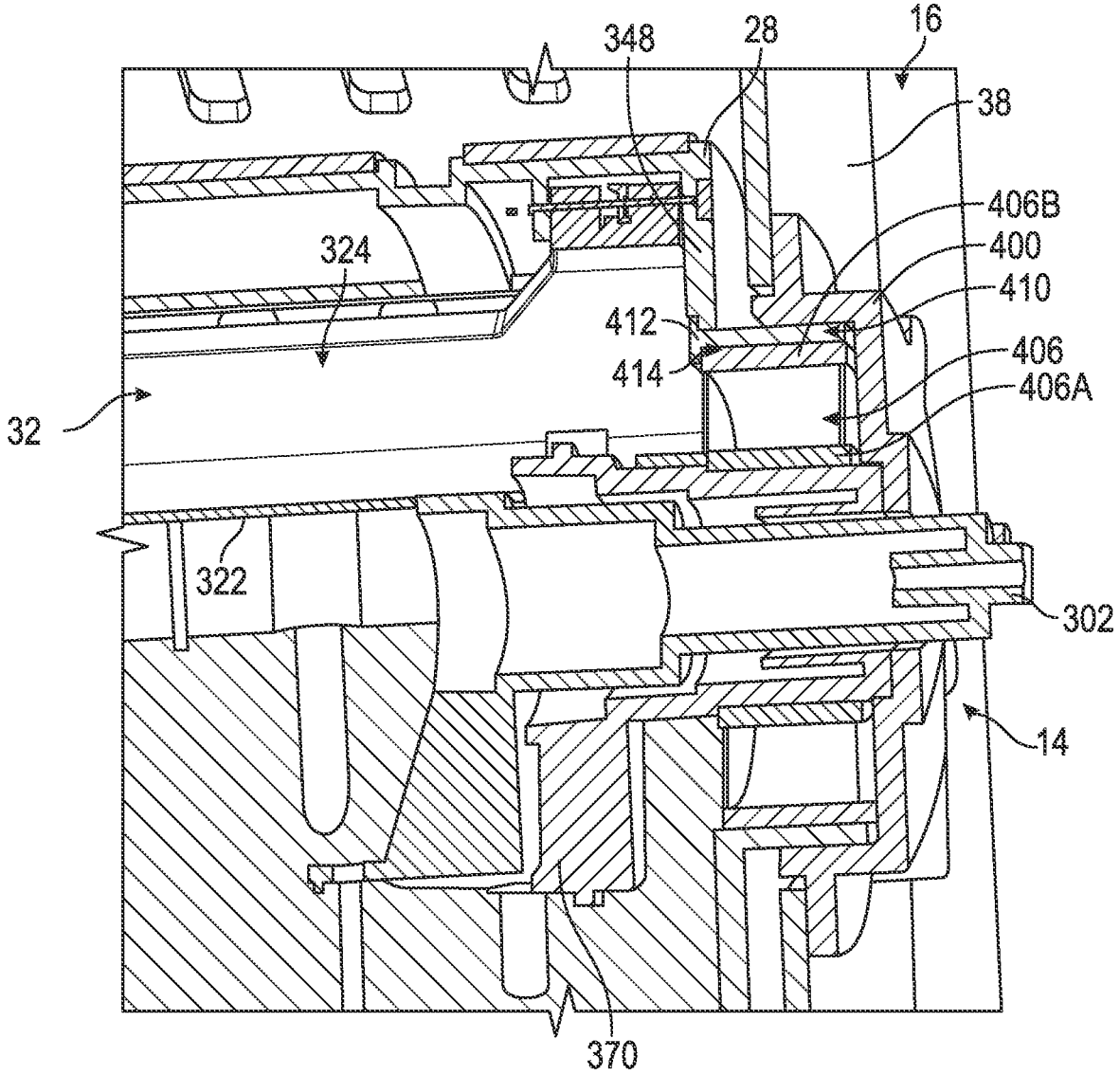
FIG. 5 shows a further cross-sectional view of a feed roller with the cutting system/assembly of FIGS. 3A and 3B.
Figure 6:
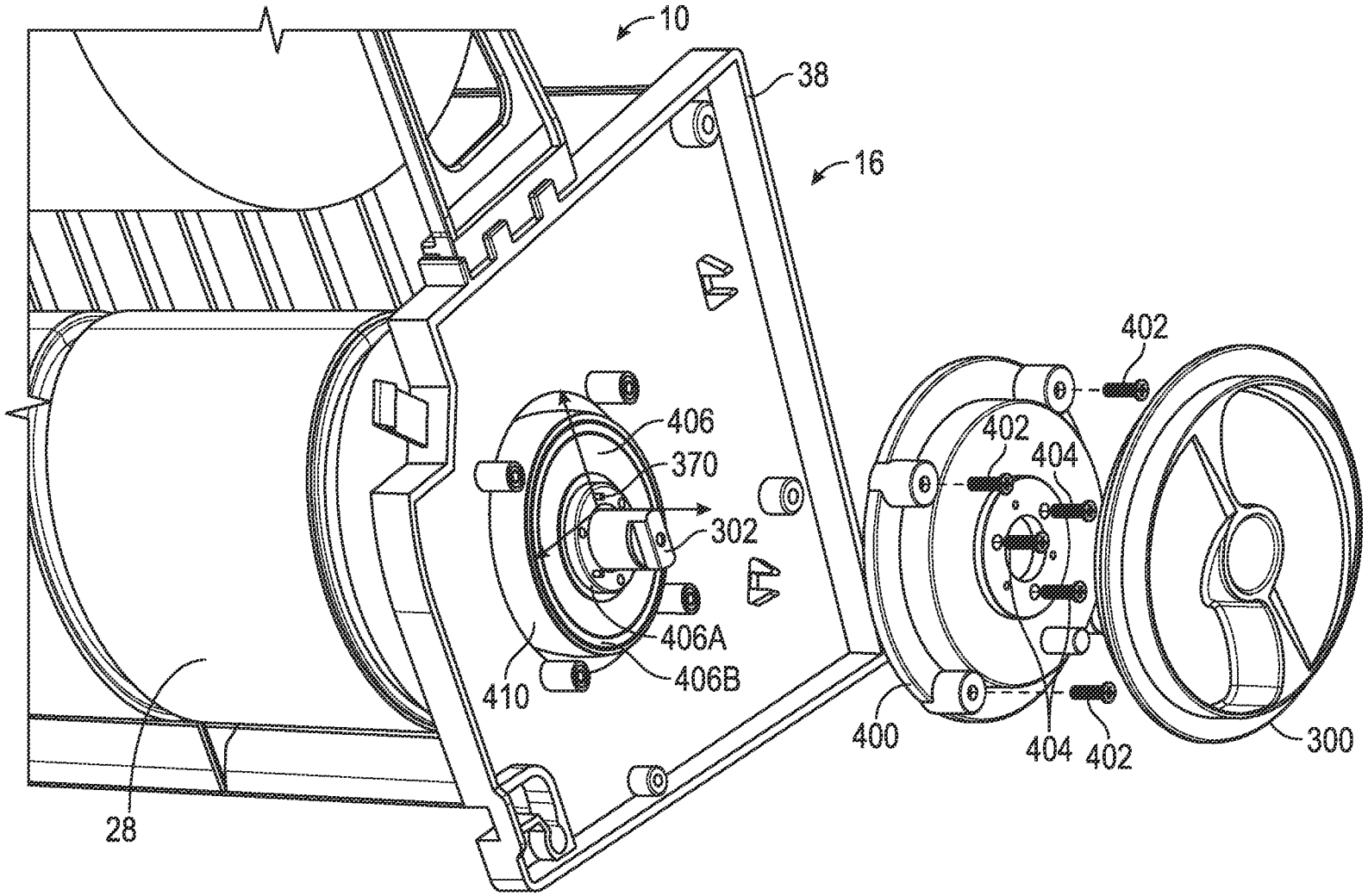
FIG. 6 shows a partial perspective view of an example manual drive mechanism according to principles of the present disclosure.

As generally illustrated in FIGS. 1-10C, the present disclosure is directed to a sheet material dispenser 10 for feeding or dispensing a flexible sheet material 12 (FIGS. 1-2). The dispenser 10 generally includes a feed roller drive assembly 14 mounted/disposed within a dispenser housing 16. The drive assembly 14 generally will be manually operated (as shown in FIGS. 5 and 6); though in some constructions the dispenser can include a motorized/driven feed roller. Upon use or activation of the dispenser 10, the feed roller drive assembly 14 for dispensing sheet material will be engaged, causing rotation of a feed roller or drive spindle 18, thereby resulting in conveyance of a measured or selected amount or length L of sheet material 12 (e.g. a sheet that can be cut and dispensed or torn or otherwise removed by a user) along a conveying or feed path P (FIG. 2) from a roll or supply 20 of the sheet material 12 and out of a dispensing throat or discharge chute 22 or other suitable aperture or opening provided/defined in the housing 16, as generally indicated in FIGS. 1 and 2. It further should be appreciated that the sheet material dispenser 10 described herein should not be considered to be limited to any particular style, configuration, or intended type of sheet material. For example, the dispenser 10 may be operable to dispense paper towels, toilet tissue, or other similar paper or sheet materials, including dispensing or feeding non-perforated and/or perforated sheet materials.

As indicated in FIGS. 1 and 2, the dispenser housing 16 generally includes a roll support mechanism 21, for holding at least one roll 23 of the supply 20 of sheet material 12. For example, the roll 23 can be supported by a pair of arms 25 coupled to the dispenser housing 16. These arms 25 may be fixedly arranged to hold the supply 20 of sheet material in a spaced relationship with the feed roller 18 or, in the alternative, the arms 25 may be biased or urged, such as by a spring, other pre-stressed member or suitable biasing mechanisms, toward the feed roller 18 to urge or direct the supply 20 of sheet material downwardly toward or against the roller 18. In an alternative construction (not shown), the roll support mechanism can include slots or grooves defined in or along the dispenser housing 16 that are configured to receive the first and/or second ends of the roll 23 of the sheet material 12, such that at least a portion of the supply 20 of sheet material 12 is supported by, and/or rests on or engages the feed roller 18. The slots or grooves of the roll support mechanism further can include one or more angled or sloped portions having a variable slope to increase/decrease the amount of force the supply 20 of sheet material exerts on the roller 18. For example, a slope can be selected such that as the supply 20 of sheet material is fed (e.g., the amount of sheet material 12 left on the roll decreases), the slope or position of the supply roll can change so as to keep a downward force exerted on the feed roller 18 by the supply roll substantially constant as the supply of sheet material, and likewise the weight thereof, is diminished as selected portions of the sheet material 12 are dispensed.

FIGS. 1 and 2 further show that the dispenser 10 also can include one or more pressing rollers 36 that can be biased toward engagement with the feed roller 18, so as to engage and force or press the sheet material 12 against the feed roller 18. The pressing roller(s) 36 can be movably mounted within the dispenser housing 16, such as with the ends thereof held within holders or brackets 36A/36B that can be biased toward engagement with the driven feed roller 18 such as by springs, biased cylinders or other suitable biasing mechanisms. The pressing rollers or a single roller, when used, also can be biased independently forward the feed roller. The pressing roller(s) 36 further can include bands of a gripping material, such as a rubber or synthetic material, to assist in pulling the sheet material therebetween without causing damage to the sheet material as it passes between the feed roller and pressing roller(s). Additional pressing or guide rollers 36C also can be arranged along the feed roller 18 to assist in guiding the sheet material, which additional rollers 36C (FIG. 2) may be fixed or biased against the feed roller body 30, such as by springs, biased cylinders or other suitable biasing mechanisms.

Figure 3A:
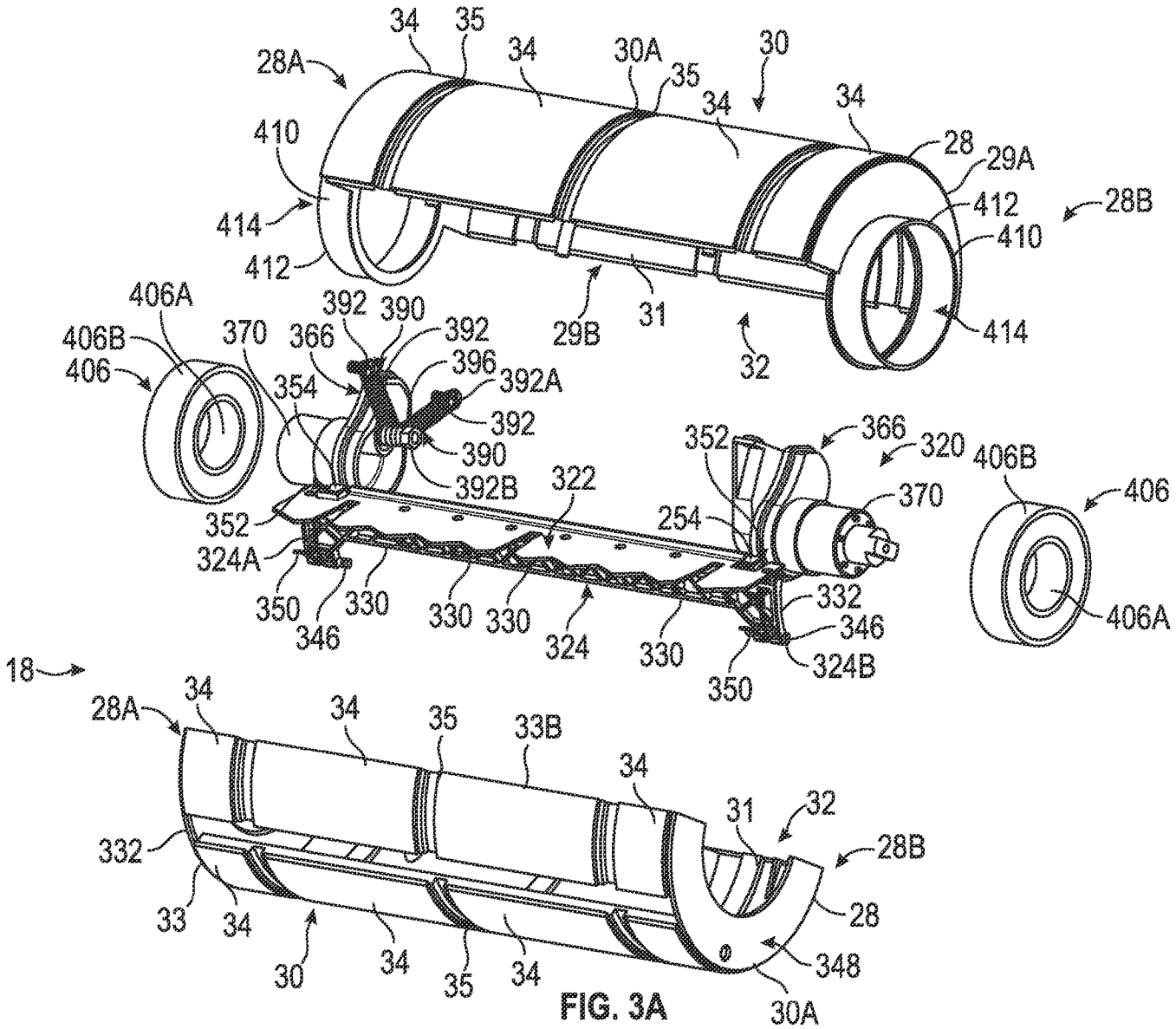
FIGS. 3A and 3B illustrate exploded views of a feed roller and cutting assembly/system according to one aspect of the present disclosure.

FIG. 3A provides an exploded view of the feed roller 18 according to one embodiment. As illustrated in FIG. 3A, the feed roller body 28 may include first and second ends 28A/28B and a generally cylindrical outer side wall 30 and an inner side wall 31 defining an open ended passage, recess, or at least partially hollow cavity 32 defined within/along the feed roller body 28, and the feed roller body 28 may also include one or more driving bands 34 disposed on, or adhered to, an outer surface 30A of the side wall 30, such as a series of driving bands or sections 34 disposed on the outer surface 30A in a spaced arrangement or configuration. The driving bands 34 may at least partially include or be comprised of rubber, plastic, resin or other similar materials suitable to increase grip of the feed roller 18 and/or friction between the feed roller 18 and the sheet material 12 to thereby assist in the feeding or driving of the sheet material 12. In addition, the outer surface 30A of the feed roller body 28 also may include a series of recessed or gap sections 35 defined therein.

As additionally illustrated in FIG. 3A, the feed roller body 28 can be made up of various sections or portions including a first section or portion 29 having, for example, a cylindrical sidewall 29A defining an open ended passage or at least a partially hollow cavity 29B therealong, and a second, or other additional, section or portion 33 connected to and/or adjacent the first section 29 also having, for example, a cylindrical sidewall 33A defining an open ended passage or at least a partially hollow cavity 33B therealong. The feed roller body 28 can be movably or rotatably mounted/attached to one or more walls or other portions of the dispenser housing 16, such as side walls 38/39 (FIGS. 1 and 5-6).

The first end 28A and/or second 28B end of the feed roller body 28 can be connected, mounted or otherwise coupled to the side walls 38/39 by one or more bearing assemblies 406 (FIGS. 3A and 5-6), and/or other suitable support mechanisms that support and allow for rotation of the feed roller body 28 in relation to the dispenser housing 16. The bearings 406 may include roller or ball bearings, though embodiments of this disclosure are not so limited and may include plain, fluid, or magnetic bearings or any other suitable mechanisms for rotatably fixing the feed roller body 28 to or within the dispenser housing 16. The first 28A and/or second 28B ends of the feed roller body 28 can be receive and engage the bearing assemblies 406 to enable the feed roller body 28 to rotate with respect to the dispenser housing 16 (FIGS. 3A and 5-6).

FIGS. 3A-B and 4A-E show a dispenser cutting assembly or system 320 according to one embodiment of the present disclosure, wherein the cutting assembly 320 can include a cutting blade 322 and a base or support 324 connected to and at least partially supporting the cutting blade 322. The base 324 can be pivotally or otherwise movably mounted within the cavity or chamber 32 defined within the feed roller body 28, such that teeth or sharpened portions 330 of the cutting blade 322 are extensible between extended and retracted positions out of and back through an opening or slot 332 defined along the feed roller body 28 by movement of the base.

Figure 3B:
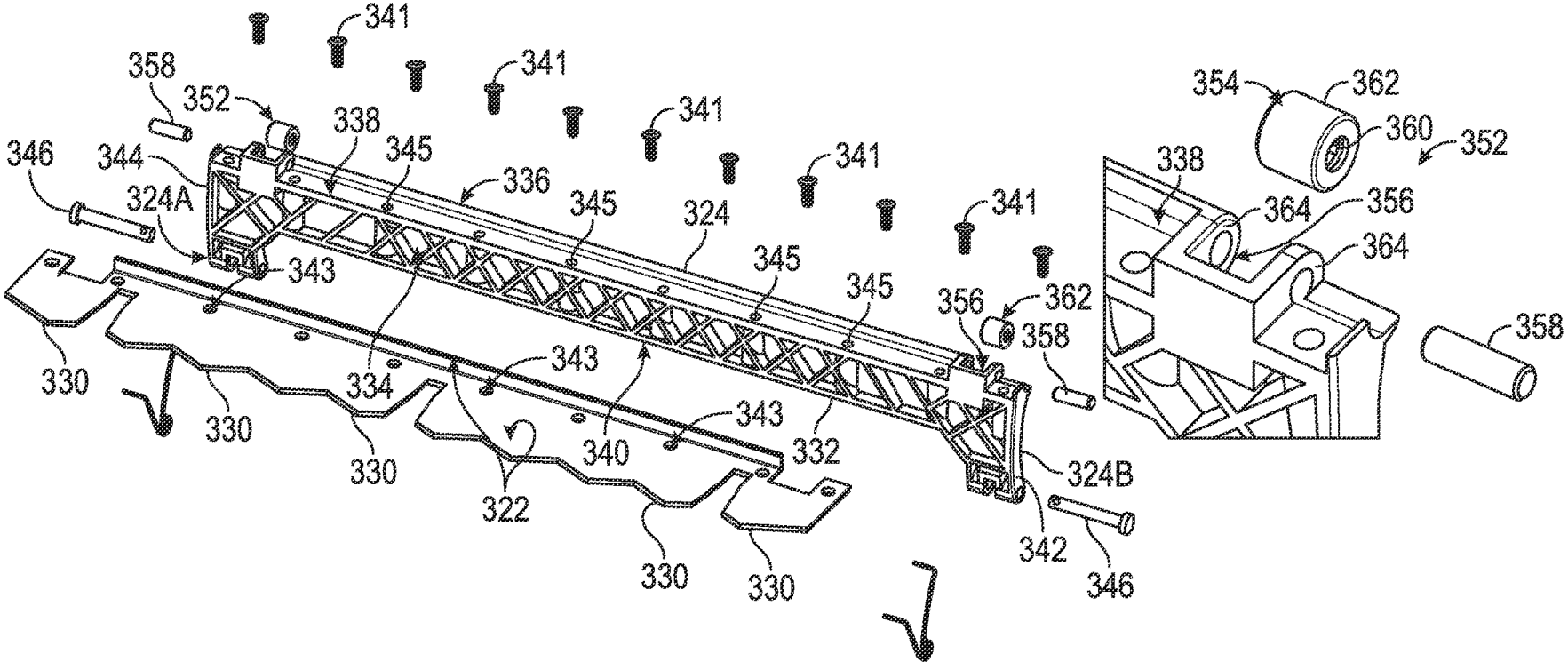

The base 324 can have a body 332 with front 334, back 336, top 338, bottom 340, and side 342/344 portions or sections (FIG. 3B). In one embodiment, the body 332 of the base 324 further can be formed from a plastic material or other polymeric material, though other suitable materials, such as rubber, wood, composites, etc., also can be used without departing from the scope of the present disclosure. The base 324 further generally will be coupled or connected to the cutting blade 322 along the top portion 338 of the base 324, for example, by a series of fasteners 341, such as screws, bolts, rivets, etc., that can be received and/or threaded through a series of holes 343 defined in/through the cutting blade 322 as well as corresponding holes 345 defined in the top portion of the base 324. However, the cutting blade 322 can be otherwise mounted to or integrally formed with the support/base 324, without departing from the scope of the present disclosure.

As generally shown in FIGS. 4A-E, the base 324 further is rotatably or pivotally coupled to at least a portion of the feed roller body 28. For example, the cutting assembly 320 can include pins 346, or other suitable connection means or connecting members, e.g., rods, bearings, etc., allowing for pivoting or rotation thereabout, to couple to ends 324A/B of the base 324 to side walls 348 of the feed roller body 28 such that the base/support 324 is rotatable/pivotable about the pins 346 and further moves/rotates with the feed roller body 28 during dispensing of the sheet material. Additionally, the cutting assembly 320 can include one or more biasing members 350, such as torsion springs, or other suitable biasing members, that are coupled to pins 346 and provide a biasing force against the support/base 324, e.g., sufficient to urge or bias the support/base 324, and thus the cutting blade 322, toward a retracted position.

FIGS. 3A-3B and 4A-4E also show that the base 324 also has a cam follower assembly 352 arranged along the top portion 338 thereof. The cam follower assembly 352 generally has one or more cam followers 354, which can include bearings, rollers, or other rotating members or portions. In one embodiment, the cam followers 354 can be at least partially received within notches or grooves 356 defined in the top portion 338 of the base 324, and can be rotatably coupled thereto by rods or pins 358, or other suitable connection mechanisms, as generally shown in FIG. 3B. The rods or pins 358 each further can be received/engaged within a hole or passage 360 defined through a body 362 of each cam followers 354 and corresponding holes/passages 364 defined along the top portion 338 of the base 224, to rotatably couple the cam followers 354 to the base 324, as generally shown in FIG. 3B.

The cam followers 354 engage and move along one or more corresponding cam surfaces or tracks 366 located within the cavity 32 of the feed roller body 28, as the feed roller body 28 is rotated, and correspondingly pivot/rotate the base 324 and move the cutting blade 322 out from and back into the opening/slot 332. For example, in one embodiment, the cutting assembly 320 can include cam members 370 that can be mounted in a substantially fixed or stationary position within the cavity 32 of the feed roller body 28, such that the feed roller body 28 and the base 324 are rotated about such cam members 370, such as indicated in FIGS. 4A-E.

The biasing member 350 further can bias or urge the cam followers 354 against and into engagement with at least a portion of the cam members 370. The cam members 370 further can have one or more protrusions, protuberances, or extending portions 372 provided therealong, such that when the protrusion(s) 372 are engaged by the cam followers 350 the biasing force of the biasing member 350 is overcome to cause the base/support 324 to pivot, rotate, or otherwise move and thereby extend the cutting blade 322 out from the opening/slot 332 in the feed roller body 28 for at least partial perforation or cutting of the sheet material. Accordingly, as shown in FIGS. 4A-E, as the feed roller body 28 is rotated to dispense sheet material 12 (and the base 324 is rotated therewith) the cam followers 354 will be pressed against/into engagement with and moved along the cam members 370 such that the support/base 324 pivots or moves the cutting blade 322 between a plurality of extended and retracted positions 374, 380, 382.

As shown in FIG. 4A, the cutting blade 322 initially can be in a rest or initial position 374, with the cam followers 354 engaging a surface or portion 375 of the cam members 370 such that the cutting blade 322 is retracted from the opening 332 in the feed roller body 28. In this rest/initial position 374, a tail or portion 376 of the sheet material 12 may hang or otherwise extend from the discharge chute 22 of the dispenser. It will, however, be understood that the present disclosure is not limited to this arrangement, and the sheet material 12 may be concealed within the dispenser or in any other suitable arrangement, without departing from the scope of the present disclosure.

FIGS. 4B-C also indicate that when the feed roller body 28 is rotated to dispense a selected amount of sheet material, for example, upon a manual activation of the dispenser, e.g., when a user turns a knob or lever 300 operatively connected to the feed roller body 28 by a post or support 302 (FIGS. 5 and 6) or pulls on the tail 276 of a hanging sheet or portion of sheet material extending from the discharge, the cam follower 354 will move along surface 375 until the cam follower 354 engages a cam surface or portion 377 of a protrusion 372 of the cam member 370 and is moved to an extent sufficient to overcome the biasing force of the biasing member 350. In response, the support/base 324 will be pivoted so as to move the cutting blade 322 to exit the opening 332 defined in the feed roller body 28 to cut, score, or perforate the sheet material 12.

In addition, FIG. 4B shows that when the feed roller body 28 is rotated an initial amount, e.g., rotated approximately 150° to approximately 180°, such as approximately 170°, from the rest position 374 in a counterclockwise direction D1, the cam follower 354 generally will begin to engage the surface or portion 377 of the protrusion 372 and the cutting blade 322 will begin to exit the opening 332. Thereafter, as shown in FIG. 4C, as the feed roller body 28 is rotated a further amount, e.g., rotated approximately 170° to approximately 200°, such as approximately 180°, from the rest position 374 in the counterclockwise direction D1, to the cam follower 354 is moved further along the surface/portion 377, causing the cutting blade 322 to extend further toward a cutting position 380 with the cutting blade 322 contacting or otherwise engaging the sheet material for cutting or perforation thereof. In one embodiment, the cam surface or portion 377 of the protrusion 372 further generally can be sloped, curved, or otherwise shaped or configured to help control the engagement of the cutting blade with the sheet material so as to substantially prevent ripping or tearing during cutting, scoring, or perforation thereof.

Subsequently, as illustrated in FIG. 4D, when the feed roller body 28 rotates an even further amount, e.g., approximately 220° to approximately 240° or more, such as approximately 230°, from the rest position 374 in the counterclockwise direction D1, the cam follower 354 is moved further along the cam surface or portion 377 such that the cutting blade 322 is moved to its fully extended position 382, with the cutting blade 322 substantially projecting or extending out of the opening 332 in the feed roller body 28.

Thereafter, as the feed roller body 28 continues to rotate and as the cam follower 354 engages and moves along cam surface or portion 379 of the protrusion 372, the cutting blade 322 is retracted back through the opening 332 in the feed roller body 28 (FIG. 4E). Additionally, when the feed roller body 28 has made a full rotation, e.g., rotated approximately 360° from its initial or rest position 374, the cam follower 354 will again engage the cam surface or portion 375 of the cam members 370 such that the cutting blade 322 is in its retracted or initial position (FIG. 4A)

FIGS. 4A and 4A-E additionally show that the feed roller body 28, in some embodiments, can include a biasing assembly 390 disposed within the body and operable or configured to assist rotation of the feed roller body 28 and/or movement of the cutting assembly 320, for example, upon manual activation of the feed roller body 28. The biasing assembly 390 can include tension springs 392, e.g., one or two tension springs, though any suitable number of springs, such as 3 or more, also can be employed without departing from the scope of the present disclosure. The springs 392 generally will be fixedly connected to the feed roller body 28 and rotatably coupled to at least a portion of one of the cam members 370, or other suitable fixed portion positioned within the cavity 326 of the feed roller body 28. For example, one end 392A of the springs 390 can be fixedly connected, such as by fasteners 394, e.g., screws, bolts, rivets, etc., to the feed roller body 28, and an opposite/opposing end 392B of the springs 392 can be rotatably connected, such as by a bearing assembly 396, or other moveable/pivotally assembly, to one of the cam members 370. The springs 392 also can be arranged such that they are transverse or oblique to one another, for example, the springs 392 can be disposed to have an angle of approximately 30°-45° therebetween, though lessor angles and/or angles up to 90° or more can be used without departing from the scope of the present disclosure.

As shown in FIG. 4A, with the cutting blade 322 at its initial or rest position 374, the springs 392 can have an initial or equilibrium length. Then, as the feed roller body 28 is rotated, the springs 392 will be elongated and can provide biased assistance for rotation of the feed roller body 28, with the spring tension further assisting movement of the cutting blade 322 for cutting, scoring, or perforating the sheet material. The springs 392 further can cause the feed roller body 28 to fully rotate, e.g., rotate approximately 360°, while also helping to return the cutting blade 322 to its initial or rest position 374, retracted into the body 28 of the feed roller.

FIGS. 5 and 6 also indicate that the cam members 370 can be attached to at least a portion, e.g., side walls 38/39, of the dispenser housing 16, for example, by support caps 400. The support caps 400 can be connected to the side walls 38/39 of the dispenser housing 16 by fasteners 402, e.g., screws, bolts, rivets, etc., and further can be connected to the cam members 370 using fasteners 404, such as screws, bolts, rivets, etc., to mount and support the cam members 370 within the cavity 326 of the feed roller body 28. As a result, the feed roller body 28 and the base 324, with the cutting blade 322 attached thereto, are supported in a manner so as to be generally rotatable about the cam member 370. Other connectors also can be used to connect the support caps 400 to the dispenser housing 16 and the cam members 370, however, such as, for example, snap-fit or press-fit connections, adhesives, etc., without departing from the scope of the present disclosure.

As further shown in FIGS. 3A, 5, and 6, the feed roller body 28 can be rotatably coupled to the cam member(s) 370 by bearings 406. For example, at least a portion of the cam members 370 will be received within a passage 408 defined through the bearings 406, and can engage an inner race 406A of the bearings 406. The bearings 406 further will be connected to the feed roller body 28 by one or more support portions 410, each of which can include a body 412 having a ring-like or circular shape and connected to or integrally formed with the sidewalls 348 of the feed roller body 28, as generally indicated in FIGS. 3A and 5. The bearings 406 further generally can be received within, e.g., fitted into, a passage 414 defined through the body 412 of each of the supports 410 to operatively connect the feed roller body 28 to an outer race 406B of the bearings 406.

Figure 7A:
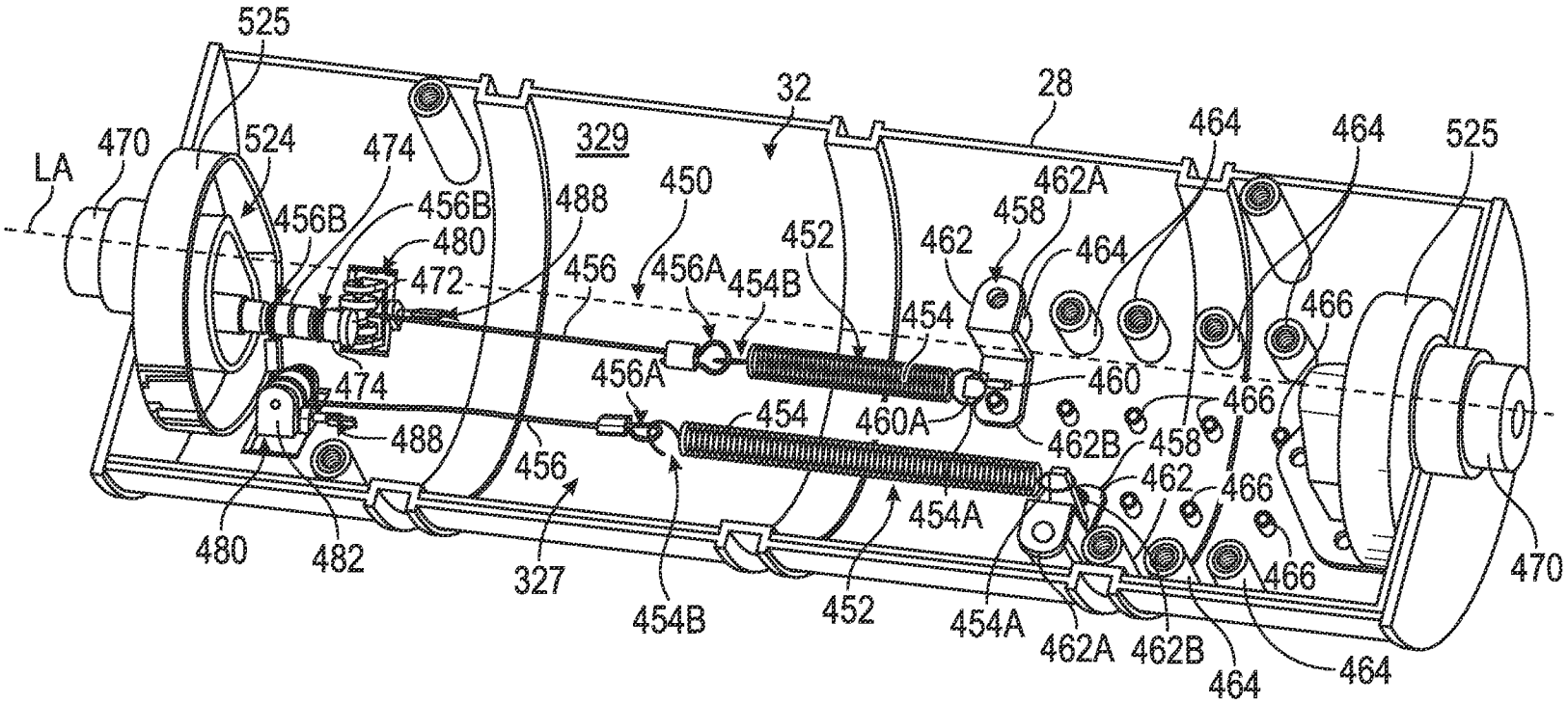
FIGS. 7A and 7B show a side elevational view and a partial side elevational view of a biasing assembly for controlling movement of a feed roller and/or cutting mechanism according to one aspect of the present disclosure.
Figure 7B:
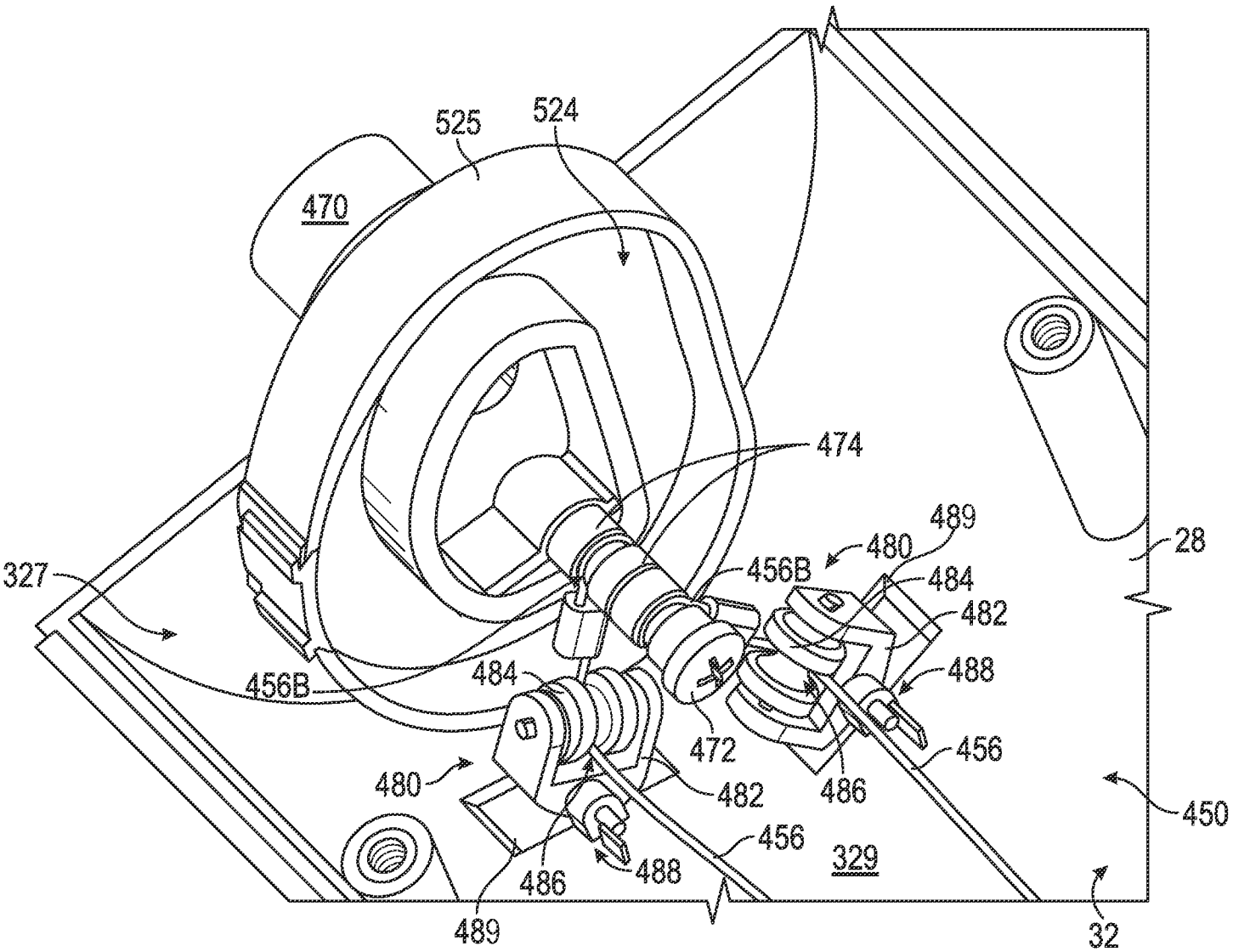

FIGS. 7A and 7B show a biasing assembly 450 for assisting in the operation/movement of the feed roller (such as for use in a manually driven or similar operation of the feed roller) for assisting movement of the feed roller for an operative cycle and to a rest or home position, wherein the cutting blade can be retracted to a non-operative position (e.g., within a recess, notch, opening, etc. in the feed roller body), according to an additional embodiment of the present disclosure.

As also shown in FIGS. 7A and 7B, the biasing assembly 450 can include one or more biasing members 452, e.g. in the embodiment illustrated, a pair of biasing members 452 are shown extending along the interior surface 329 of the feed roller body 28. It will be understood that fewer or more biasing elements can be used without departing from the scope of the present disclosure. Each biasing member 452 can comprise a tension spring or other suitable tensioning or biasing member having an elongated spring body 454 with first and second ends 454A/B. The biasing members 452 also generally extend in a direction along, e.g., generally parallel, to the longitudinal (or rotational) axis (axis LA shown in FIG. 7A) of the feed roller body 28, and can be fixedly attached to the interior surface 329 of the feed roller body 28.

The first or distal end 454A of each biasing member 452 can engage and couple to a connection mechanism 458, such as flange, arm, or other connecting member attached to the feed roller body 28 by one or more fasteners, (e.g., a screw, rivet, or other fastener). For example, in one embodiment, as illustrated in FIGS. 7A-7B, the first end 454A of the spring body 454 of each biasing member 452 can include a hoop, ring, hook or other suitable feature or mechanism that connects to a protruding portion 460 formed with, or connected to the connection mechanism 458, which portion 460 has a notch or opening 460A for receiving the hoop, ring, or hook of the spring. The second end 454B of each biasing member 452 can be similarly attached to a connecting linkage 456 that is connected to a bearing assembly 470 for the feed roller as indicated in FIGS. 7A-7B.

In one example, the connection mechanism 458 can include a body 462 that is connected to, or engages, portions or protrusions 464 and 466 fixed to, or integrally formed with, the feed roller body 28, e.g., at first and second ends 462A and 462B of the body 462. The protrusions 464 and 466 can be received within openings or apertures defined along the ends 462A and 462B of the body 462, and/or can include threaded openings defined therein to receive fasteners passed through the openings in the ends 462A/462B of the body 462 to secure the body 462 to the feed roller body 28. The body 462 can have a generally Z-shaped cross-section to facilitate connection of the body 462 to the portions 464/466, though the body can have other suitable shapes and configurations, without departing from the scope of the present disclosure.

In one variation or alternative constructions, the feed roller body 28 can have a plurality of attachment points 464/466 about the interior surface 329 thereof. For example, the feed roller body 28 can have multiple portions 464/466 formed/connected to the feed roller body 28 in spaced series to allow for adjustment (e.g., tightening or loosening) of the biasing members 452, e.g., to accommodate different sheet material sizes and/or to correct for time dependent displacement or movements of the spring due to the repeated loading. In one embodiment, up to five attachment points can be provided, though any suitable number of attachment points, e.g., 2, 3, 4, or more than 5, can be employed without departing from the scope of the present disclosure.

FIGS. 7A and 7B further show that each linkage 456 can include a wire, band, or rod 468, or other flexible coupling or connector, with first and second ends 456A/456B. The first end 456A of each linkage 456 can be formed as a looped end, and can be connected to the second end 454B of its corresponding biasing member 454 such as by a hook, hoop, or split-ring type of connection forming the second end 454B of the biasing member 454. The second end 456B of each linkage 456 can be formed with a similar looped end and generally will be rotatably connected to the bearing assembly 470, such as by attachment to a fastener 472 (e.g., screw, bolt, etc.) or other suitable connection mechanism. The fastener 472 also can have one or more spacers 474 received therealong to engage and facilitate alignment of the second looped ends 456B of the linkages 456 (FIGS. 7A and 7B).

Additionally, the biasing assembly 450 can include one or more pulley assemblies 480 (as shown in FIGS. 7A and 7B) that engage and facilitate a change in the direction of the linkages 456 operatively connecting the biasing members 452 to the bearing assembly 470 (e.g., such that an axial pull force or tension along the biasing members 452 can be converted into a radial pull force or tension to maintain or assist in rotation of the feed roller body 28 and/or movement of the cutting mechanism). Each of the pulley assemblies 480 can include a bracket 482 that is connected to the interior surface 329 of the feed roller body 28 and that at least partially supports a pulley 484 having a track or race 486 against which at least a portion of the linkage 456 is engaged and/or moves.

As shown in FIG. 7B, the pulley brackets 482 can be pivotally or rotatably mounted (e.g., by a pinned or hinged connection 488) to the interior surface 329 of the feed roller body 28. The pinned or hinged connection 488 can help to maintain engagement between, and/or substantially prevent misalignment of, the linkage 456 and the race 486 of the pulleys 484, e.g., as/when the feed roller body 28 is rotated and the biasing assembly 450 is rotated therewith. The interior surface 329 of the feed roller body 28 further can have a notch or recessed portion 489 formed/defined therein to accommodate movement/pivoting of the brackets 482.

In operation, upon activation of the feed roller 28 (e.g., when a user pulls a hanging tab or portion of sheet material or turns a knob or lever connected to the feed roller), the feed roller body 28 rotates and carries the biasing assembly 450 therewith. As a result, the linkages 456 are caused to be pulled or otherwise engaged about the pulleys 484, tensioning and stretching the spring bodies of the biasing members 452, thus creating tension in or along the biasing members 452. This tension assists in the rotation of the feed roller and helps urge the feed roller body 28 to facilitate return of the feed roller body 28 to its rest or home position. In one example, the rotation of the feed roller can be sufficient to generate a tab or portion for pulling or engagement by subsequent users for dispensing a selected portion of sheet material. Also, this tension helps facilitate rotation of the feed roller body 28 sufficient to cause activation or movement of the cutting blade of the dispenser to cut, perforate, or otherwise cause or assist in separation of a sheet of the paper material. The return movement of the feed roller body 28 also can cause retraction of the cutting blade (e.g., into a notch, recess, opening, etc. in the feed roller body).

Figure 8A:
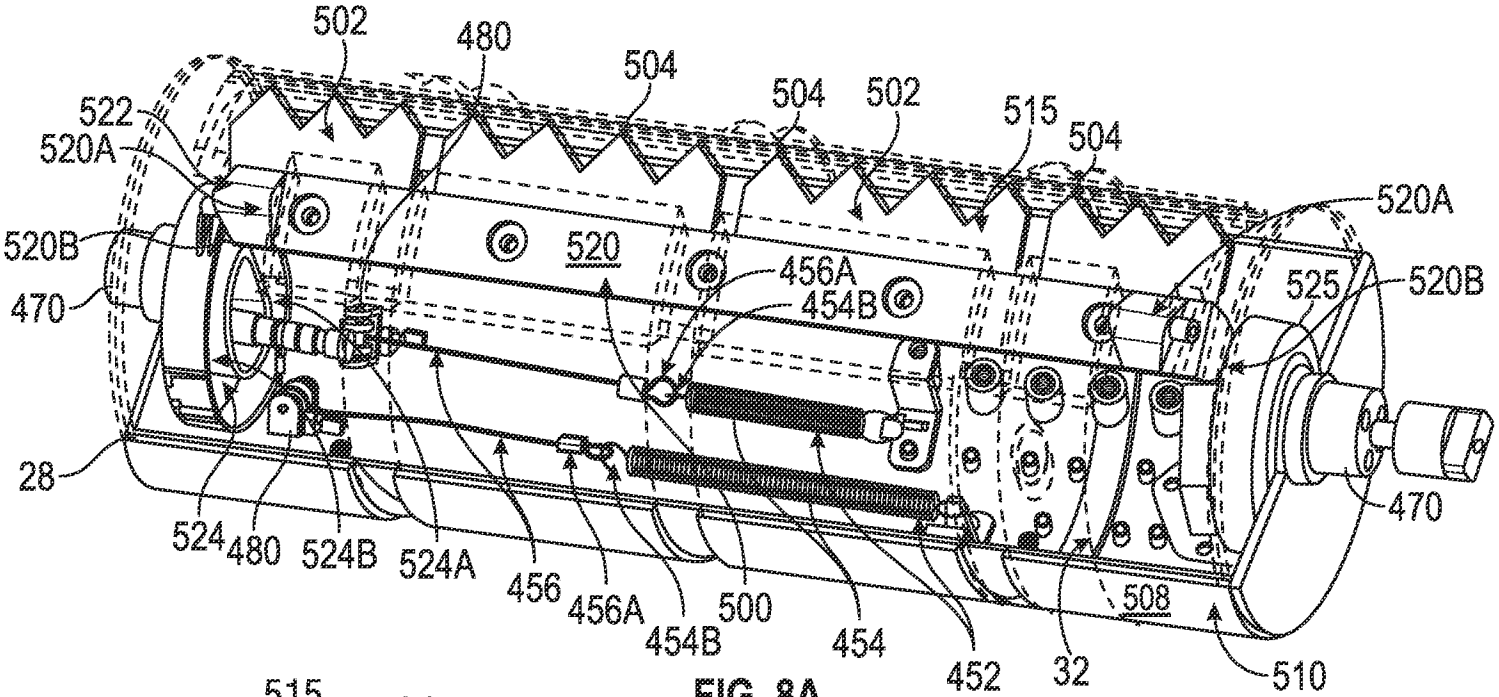
FIGS. 8A and 8B show a partial side elevation view and a side elevation views of the feed roller with a cutting system according to an additional aspect of the disclosure.
Figure 8B:
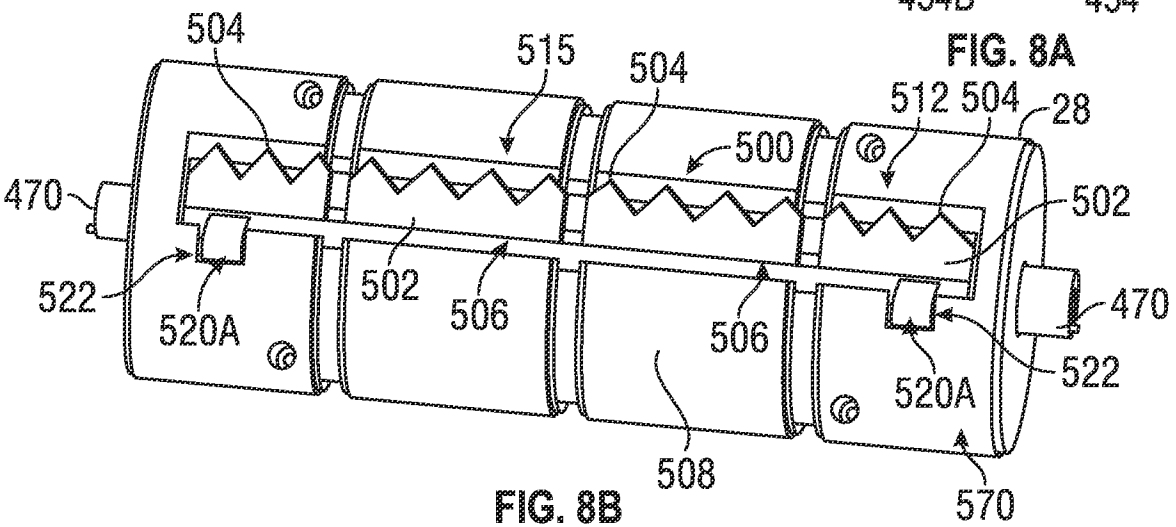
Figure 9A:
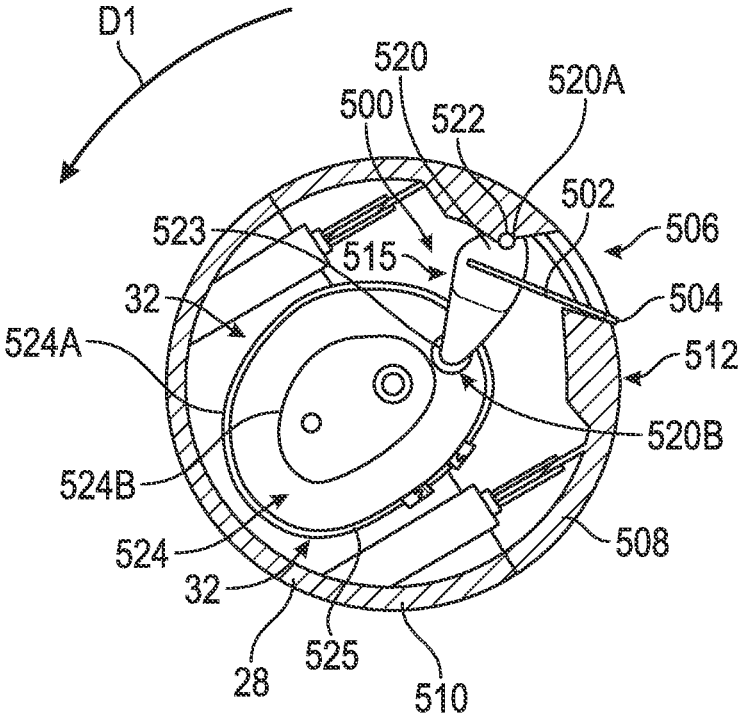
FIGS. 9A, 9B, and 9C show cross-sectional views illustrating the various positions of the cutting mechanism of FIGS. 8A and 8B.

FIGS. 8A-8B and 9A-9C illustrate a cutting assembly 500 according to an additional embodiment of the present disclosure, which cutting assembly 500 includes a cutting blade or portion 502 (e.g., having a plurality of spaced serrated or sharpened portions 504) that includes a linkage or similar structure that controls movement of the cutting blade 502. As shown in FIGS. 8A and 8B, the cutting blade 502 is received within a notch or recess 506 defined along an outer surface 508 of a cylindrical side wall 510 of the feed roller body 28, when the cutting blade 502 is in a retracted position 512 (as shown in FIGS. 8A, 8B, and 9A). The cutting blade 502 is moveable to an extended position 514 whereupon it at least partially projects from the notch/recess 506 of the feed roller body 28 to an extent sufficient to enable the blade 502 to engage the sheet material as it is dispensed to at least partially cut, score, or perforate a portion thereof.

The cutting assembly 500 also includes a linkage assembly 515 with a moveable support or body 520 that is connected to (or integrally formed with) and supports the cutting blade 502. A first end or portion 520A of the support 520 is rotatably, pivotally, or otherwise moveably connected to the feed roller body 28. In one example, the first end or portion 520A of the support 520 can include a pivotable or rotatable connection mechanism, such as a pinned or hinged connection 522, or other suitable connector for pivoting, rotation, or other movement thereabout. A second, free end 520B of the support 520 is attached to a cam follower 523, such as a roller, bearing, etc., that is received within and rides along a cam track 524 as the feed roller body 28 is rotated to dispense selected portions of the sheet material.

The cam track 524 is positioned/formed within selected positions of feed roller body 28, (e.g., within the interior cavity or chamber 32 thereof), and in one variation, the cam track 524 can be integrally formed with, or otherwise connected to, the bearings 470 supporting the feed roller body 28 and allowing rotation thereabout. In one embodiment, the cam track 524 can be defined in a track body or component 525 that is integrally formed with, or otherwise attached to, the bearing 470. In alternative constructions, the cam track 524 can be integrally formed with or otherwise defined in or along the feed roller body 28 or other portions attached thereto. As a result, as the feed roller is rotated to dispense the sheet material, the feed roller body 28 rotates about the cam track 524 moving the cam follower 523 therealong. As components of the cutting assembly 500 (e.g., the cam track 524) and the biasing assembly integrated with the feed roller body, e.g., housed within the feed roller body, tampering, damaging, unwanted access to, etc. of these components can be substantially minimized, inhibited, or prevented.

As additionally shown in FIGS. 8A-8B and 9A-9C, the cam track 524 is shaped, positioned, or otherwise configured such that the support 520 is rotated or pivots, moving the cutting blade between the retracted and extended positions 512 and 514, with rotation of the feed roller. For example, the cam track 524 has an outer surface 524A and an opposing inner surface 524B that contact or otherwise engage the cam member 523, and the cam track 524 controls/engages the cam follower 523 to engage and move the second end 520B of the support 520 towards and away from the wall 510 of the feed roller body 28 to pivot or otherwise move the support 520 about the rotatable connection mechanism 522 at its first end or portion 520A.

Figure 9B:
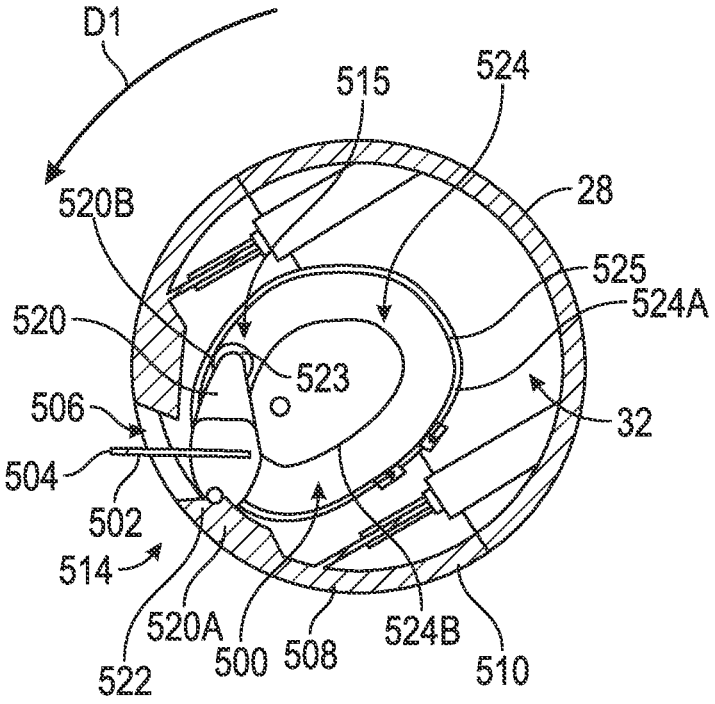
Figure 9C:
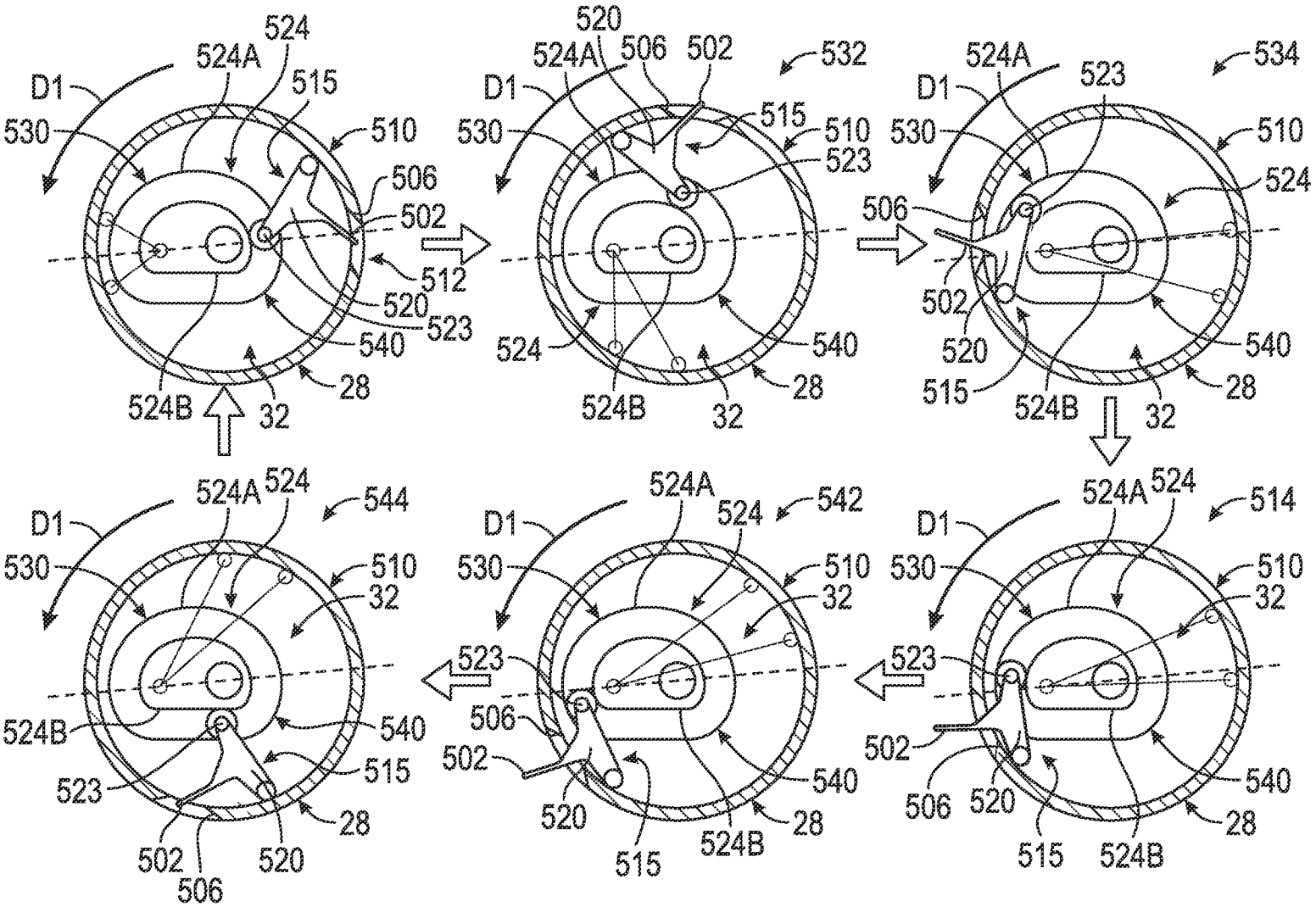

FIGS. 9A-9C illustrate cross-sectional views of the cutting assembly 500 and the feed roller body 28 showing movement of the cutting mechanism 500 between its initial, retracted or rest position 512 and its extended, cutting position 514 with rotation of the feed roller. FIG. 9A shows the cutting mechanism 500 in the initial, retracted position 512, FIG. 9B shows the cutting mechanism 500 in the extended, cutting position 514, while FIG. 9C illustrates movement of the cutting mechanism 500 across approximately 360-degree rotation of the feed roller body 28.

As shown in FIGS. 9A and 9C, in its retracted position 512, the cutting blade 502 is received within the notch or recess 506 and does not extend from the side wall 510 of the feed roller body 28 (e.g., such that sheet material can be received about the notch/recess without interference from the cutting blade). Then, as the feed roller body 28 is rotated (e.g., in the counterclockwise direction D1 shown in FIGS. 9A-9C) to dispense a selected amount of sheet material, the cam follower 523 will enter/engage a first portion 530 of the cam track 524, causing the cutting blade 502 to extend out from the notch 506 (at position 532). As the feed roller further rotates in the counterclockwise direction, the cam follower 523 further moves along/engages the first portion 530 of the cam track 524 to further extend the cutting blade 502 from the notch 506. The cam follower 523 will move along the first portion 530 of the cam track 524 with rotation of the feed roller body 28 until the cutting mechanism 502 is moved to its extended position 514 to substantially cut or perforate the sheet material as it is being dispensed, as generally shown in FIGS. 9B and 9C.

After the cutting blade 502 has reached its extended position (e.g., as shown at 514) and as the feed roller body 28 is continued to be rotated (e.g., under tension of the biasing assembly), the cam member 523 will begin to enter/engage a second portion 540 of the cam track 524 that facilitates return of the cutting blade 502 to its initial, retracted position 512 (e.g., as shown at 542). As the feed roller body 28 continues to rotate (e.g., under tension of the biasing assembly 450), the cutting blade 502 will return to its initial rest position 512 with the cutting mechanism 502 retracted within the notch 506.

FIGS. 9A-9C further show that the cam track 524 is shaped, positioned, and/or configured to move the second end 520B of support 520 to be in relatively closer proximity to the side wall 510 of the feed roller body 28 as the cutting blade 502 is moved toward its extended position (e.g., position 514). The track 524 further is shaped to move the second end 520B of the support 520 relatively further away from the side wall 510 of the feed roller body 28 to return the blade 502 to its retracted position 512. As a result, the cutting blade 502 is moved or driven by the linkage assembly 515, which movement can be controlled without requiring springs or other biasing members to return the blade 502 to the retracted position 512 (or to move the blade 502 to the extended position 514), e.g., enabling enhanced control and improved reliability, and/or cleaner cutting of the sheet material.

The cam track 524 further can be shaped, positioned, and/or configured such that the cutting blade 502 is in its extended position 514 (or other positions) at a selected or desired positions within the housing of the dispenser. For example, the cam track 524 may be shaped, positioned, and/or configured such that the cutting blade 502 only extends within the chamber of the housing, or does not extend at a position in which the cutting blade 502 would be exposed to users or maintenance personnel, e.g., to substantially prevent injury thereto or damage to the cutting blade.

Figure 10A:
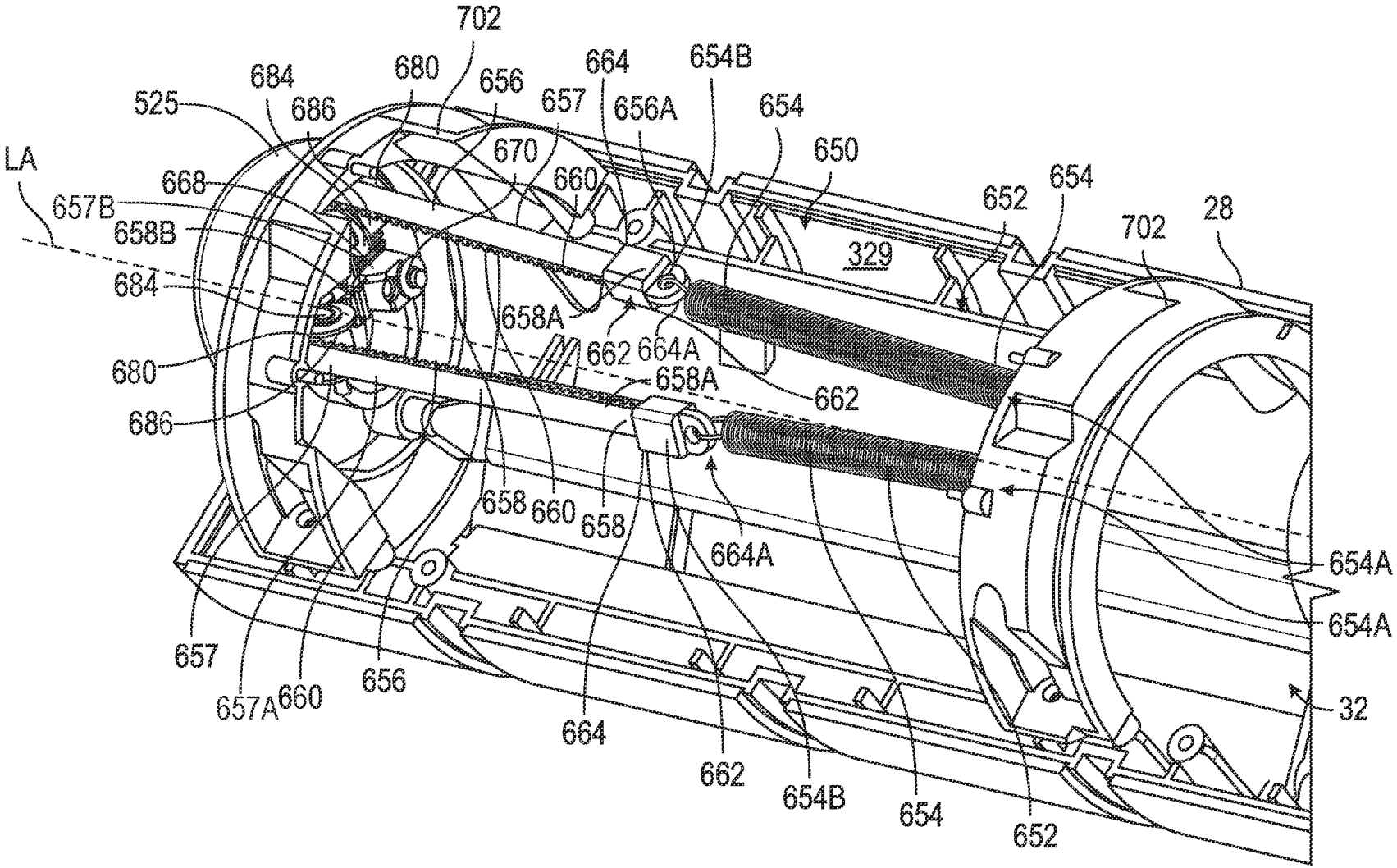
FIGS. 10A, 10B, and 10C show partial cutaway, perspectives view of a biasing assembly for controlling movement of a feed roller and/or cutting mechanism according to an additional aspect of the present disclosure.
Figure 10B:
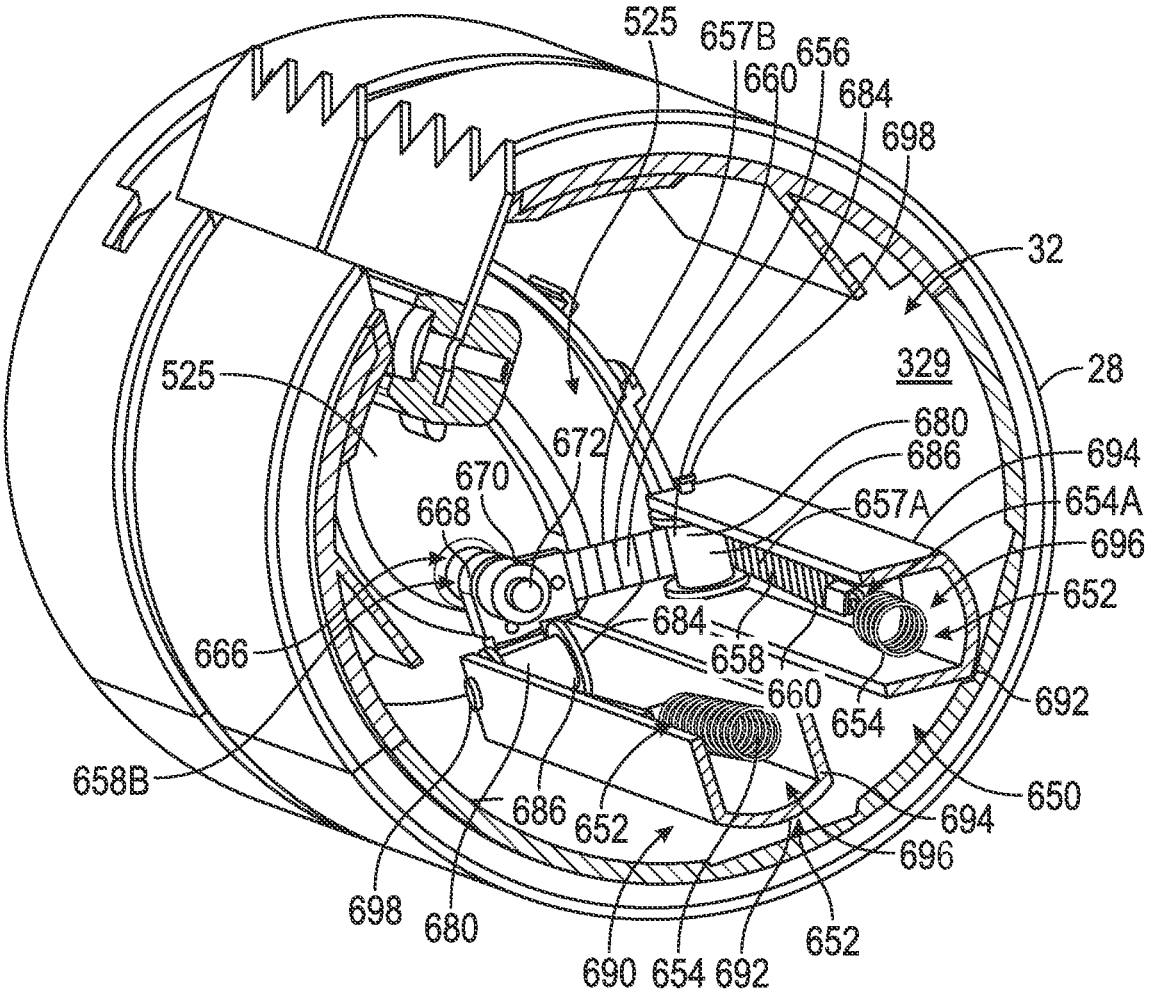
Figure 10C:
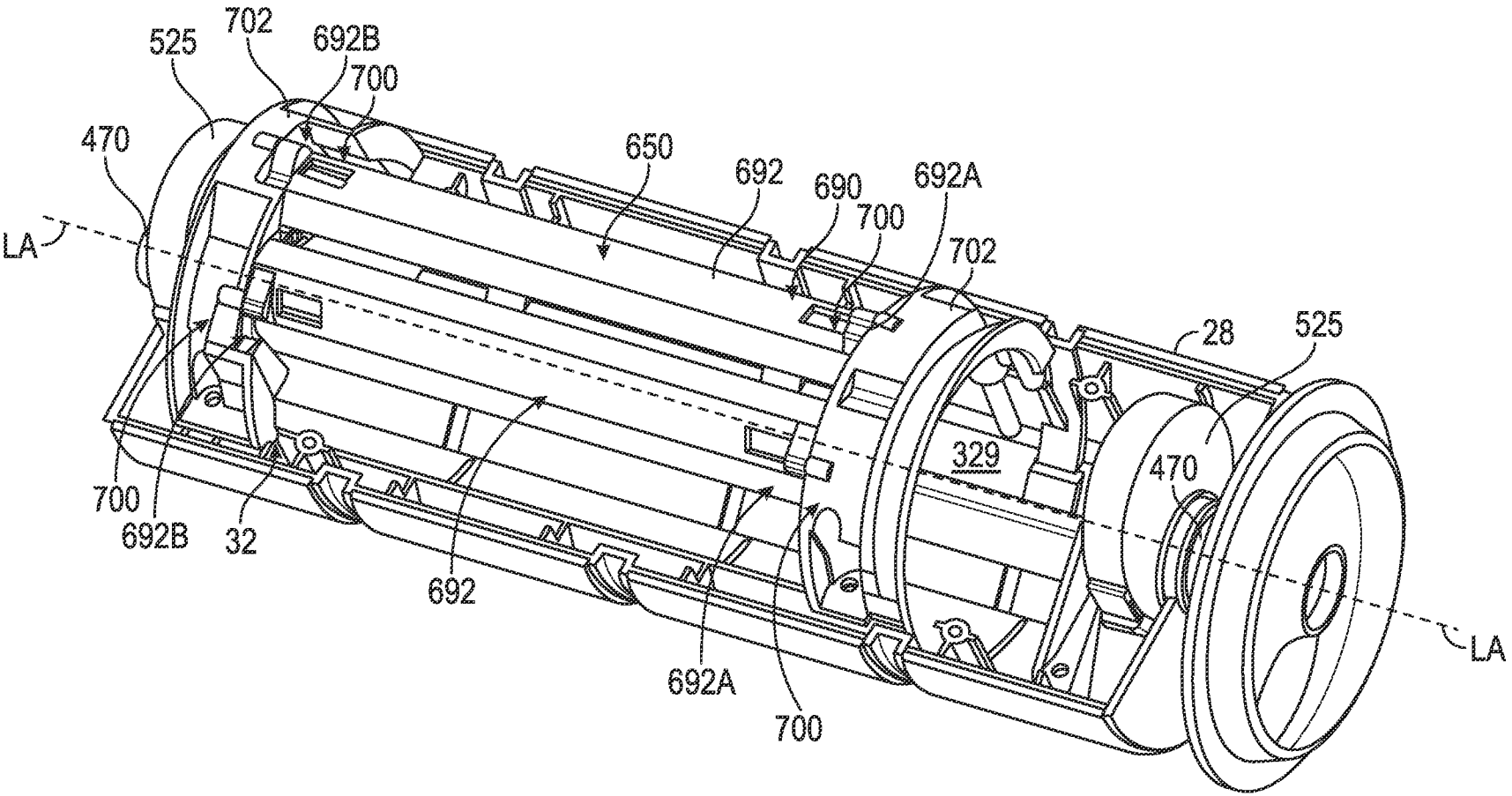

FIGS. 10A-10C illustrate a biasing assembly 650 according to yet another embodiment of the present disclosure. As shown in FIGS. 10A-10C, the biasing assembly 650 includes a plurality of biasing members 652, such as two or more biasing members 652, extending along the interior surface 329 of the feed roller body 28, e.g., in a direction that extends generally along the longitudinal (or rotational) axis (axis LA shown in FIGS. 10A and 10C) of the feed roller body 28. In one embodiment, the biasing members 652 can be generally parallel to the longitudinal axis LA; however, in other embodiments, the biasing members 652 can be set at an angle in relation to the longitudinal axis LA. The biasing members 652 can include tension springs with an elongated spring body 654 having first and second ends 654A/B, though other suitable tensioning or biasing members can be used without departing from the scope of the present disclosure. In one embodiment, one of the spring bodies 654 can have a length that is longer than another one of the spring bodies 654, though the spring bodies 654 can have generally the same length, without departing from the scope of the present disclosure.

As further illustrated in FIGS. 10A and 10B, the first end 654A of the biasing members 652 is connected to the feed roller body 28, and the second end 654B of the biasing members 652 is connected to a linkage 656. The linkage 656 is operatively connected to the bearing assembly 470, e.g., connected to the track body 525 formed therewith, or other suitable, fixed component that does not rotate with the feed roller body 28. The linkage 656 further generally includes a belt 657 having a belt body 658 with a plurality of cogs or teeth 660 or other suitable gripping projections extending along the belt body 658. The belt body 658 generally is formed from an elastomeric material, such as rubber, though the belt body 658 can be formed from other suitable materials, e.g., plastics or other polymeric materials, or combinations of materials, without departing from the scope of the present disclosure.

FIGS. 10A and 10B additionally show that the first end 656A of each linkage 656 can include a connector 662 having a connector body 664 that includes a looped or hooked end 664A that is connected to the second end 654B of a corresponding biasing member 454 (e.g., by a hook, hoop, or split-ring type of connection forming the second end 654B of the biasing member 654). The connector body 664 can be formed from a plastic or other suitable polymeric material, and further can be attached to the belt body 658 at a first end 658A thereof (e.g., by a fastener, adhesive, or other suitable fixing mechanism, such as, snap-fitting, frictional connection, etc.). The second end 656B of each linkage 656 can include a rotatable connection assembly 666 that is movably connected to the bearing assembly 470, e.g., to the track body 525 formed therewith.

The rotatable connection assembly 666 can include a rotatable body 668 that is connected to the track body 525 by a pinned connection or other suitable connection that allows for rotational movement between the rotatable body 668 and the bearing assembly 470. In the illustrated embodiment, the rotatable body 668 includes a passage 670 defined therethrough that is sized and configured to receive a pin or axle 670 that is connected to the track body 525 and facilitates rotation of the rotatable body 668 relative thereto. The pin 670 can support the rotatable bodies 668 of the linkages 656 for each of the plurality of biasing members 652 in an adjacent series, e.g., the rotatable bodes 668 can be positioned next to or adjacent to each other along the pin 670, so as to be supported thereby. The rotatable body 668 further can be formed from a plastic or other suitable polymeric material, and can be fixed to a second end 658B of the belt body 658 (e.g., by a fastener, adhesive, or other suitable fixing mechanism, such as snap-fitting, frictional connection, etc.).

Additionally, the biasing assembly 650 can include one or more pulley assemblies 680 (as shown in FIGS. 10A and 10B) that engage and facilitate a change in the direction of the linkages 656 operatively connecting the biasing members 652 to the bearing assembly 470 or track body 525 (e.g., such that an axial pull force or tension along the biasing members 652 can be converted into a radial pull force or tension to maintain or assist in rotation of the feed roller body 28 and/or movement of the cutting mechanism). Each of the pulley assemblies 680 can include a pulley 684 having a track or race 686 against which at least a portion of the belt body 658 is engaged and/or moves. The pulley 684 can include a plurality of teeth or cogs (not shown) that correspond to an engage the cogs 660, such as to substantially reduce, inhibit, or prevent slippage or other disengagement between the pulley 684 and the belt body 658. Each pulley 687 further generally engages a corresponding belt 657 such that a first portion 657A of the belt 657 is generally aligned with its corresponding biasing member 652, e.g., extends in a direction along the longitudinal axis LA, and a second portion 657B of the belt 657 is generally arranged to be transverse to the biasing member 657, e.g., extends radially in relation to the feed roller body 28 or in a direction that otherwise transverse to the longitudinal axis LA of the feed roller body 28.

Accordingly, upon activation of the feed roller 28 (e.g., when a user pulls a hanging tab or portion of sheet material or turns a knob or lever connected to the feed roller), the feed roller body 28 rotates and carries the biasing assembly 650 therewith. As a result, the linkages 656 are caused to be pulled or otherwise engaged about the pulleys 684, tensioning and stretching the spring bodies of the biasing members 652, thus creating tension or force in or along the biasing members 652. This substantially linear force or tension can be translated into a rotational or radial tension force by the biasing assembly 650 to assist in the rotation of the feed roller and help urge the feed roller body 28 to return to its rest or home position. In one example, the rotation of the feed roller can be sufficient to generate a tab or portion for pulling or engagement by subsequent users for dispensing a selected portion of sheet material. Also, this tension helps facilitate rotation of the feed roller body 28 sufficient to cause activation or movement of the cutting blade of the dispenser to cut, perforate, or otherwise cause or assist in separation of a sheet of the paper material. The return movement of the feed roller body 28 also can cause retraction of the cutting blade (e.g., into the notch, recess, opening, etc. in the feed roller body).

FIGS. 10B and 10C further indicate that the biasing assembly 650 can include a support assembly 690 that is configured to support the biasing members 652, linkages 656, and pulleys 684 along the feed roller body 28, e.g., to help facilitate alignment of, or to help to substantially reduce, prevent, or inhibit misalignment of, the biasing members 652, linkages 656, and/or pulleys 684 when the biasing assembly 650 is rotated or otherwise moved with the feed roller body 28. As shown in FIGS. 10B and 10C, the support assembly 690 can include brackets or other suitable supports 692 corresponding to each of the biasing members 652. The brackets 692 can include an elongated bracket body 694 with a passage or channel 696 defined therealong that receives corresponding biasing members 652, linkages 656, and pulleys 684. The brackets 692 can support and/or engage the biasing members 652, linkages 656, and pulleys 684 such that the biasing members 652, linkages 656, and pulleys 684 move substantially in unison with each other, e.g., as a unit, to reduce, inhibit, or prevent dislocation or misalignment thereof during rotation or other movements of the feed roller body 28.

The bracket body 694 can be formed from a plastic or other polymeric material, though other suitable materials, such as materials sufficient rigidity to help to facilitate alignment of the biasing members 652, linkages 656, and/or pulleys 684 can be used without departing from the scope of the present disclosure. The biasing members 652 can be connected to a first end 692A of the bracket body 692 (e.g., a hooked or looped end of the springs 654 can be connected to a rod, pin, or other fastener, such as a screw, bolt, etc., that is attached to the bracket body 625). The pulleys 684 can be connected to a second end 692A of the bracket body 692. In the illustrated embodiment shown in FIG. 10B, the pulleys 684 are connected to the bracket body 692 by a pin or rod 698 that allows for rotation or pivoting of the pulleys 684 thereabout.

As additionally indicated in FIG. 10C, the brackets 692 can be pivotally or rotatably mounted (e.g., by a pinned or hinged connection 700) to the interior surface 329 of the feed roller body 28. The pinned or hinged connection 700 can help to maintain engagement between, or substantially prevent misalignment of, the biasing members 652, linkages 656, and/or pulleys 684 as/when the feed roller body 28 is rotated. FIG. 10C shows that the brackets 692 are connected to the feed roller body 28 at the first and second ends 692A and 692B thereof by corresponding pinned connections 700. For example, the pinned connections 700 can allow for some give or movement of the brackets 692 and the supported biasing members 652, linkages 656, and/or pulleys 684 in relation to the feed roller body during rotation thereof for dampening of accelerations, vibrations, etc. and substantially reducing, inhibiting, or preventing dislocation or misalignment thereof.

In the embodiment illustrated in FIGS. 10A and 10C, the support assembly 690 also includes bearing supports 702 that support and connect the brackets 692 to the feed roller body 28. That is, the brackets 692 can be connected to the bearing supports 702 by the pinned connection 700, and the bearing supports 702 can be connected to the feed roller body 28 (e.g., the bearing supports 702 can be connection to the feed roller body 28 by fasteners, such as screws, bolts, etc. though the bearing supports 702 can be otherwise connected to the feed roller body 28, such as by an adhesive, snap-fitting, or other suitable attachment mechanism, without departing from the scope of the present disclosure). The bearing supports 702 generally can include a bearing support body 704 that includes a generally arcuate, curved, or cylindrical shape and is sized and/or otherwise configured to generally conform to or be complementary to the interior surface 329 of the feed roller body 28. The bearing support body 704 further can be formed from a plastic or polymeric material, though other suitable materials, e.g., other synthetic or composite materials, can be used without departing from the scope of the present disclosure. The interior surface 329 of the feed roller body 28 further can have a notches or recessed portions 706 formed/defined therein to accommodate movement/pivoting of the brackets 692 about the pinned connection 700. Furthermore, it will be understood that the bearing supports 702 can be omitted and the brackets 692 can be directly or otherwise connected to the feed roller body 28, without departing from the scope of the present disclosure.

Figure 11A:
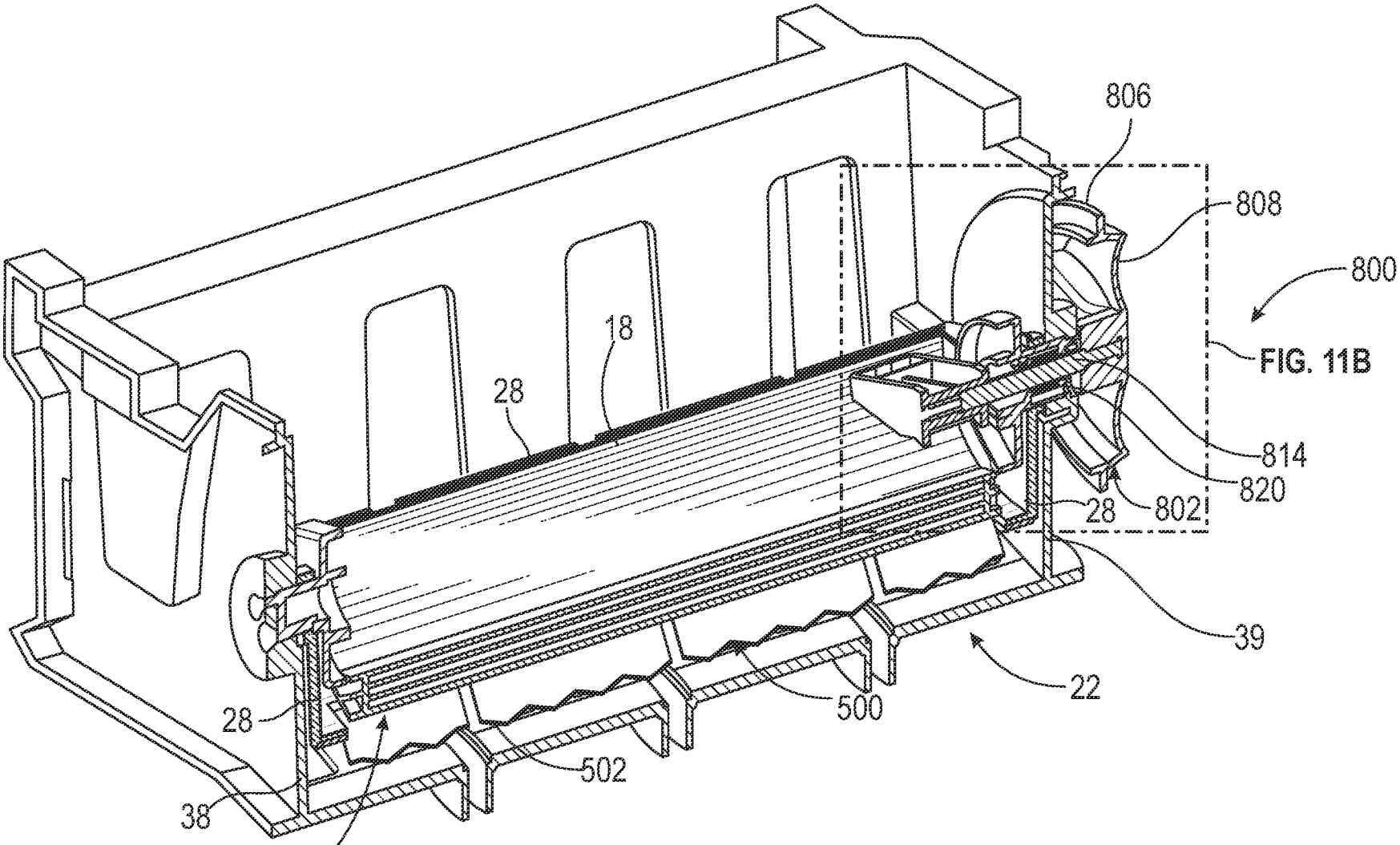
FIGS. 11A, 11B, and 11C show various views of a manual dispensing assembly according to principles of the present disclosure.
Figure 11B:
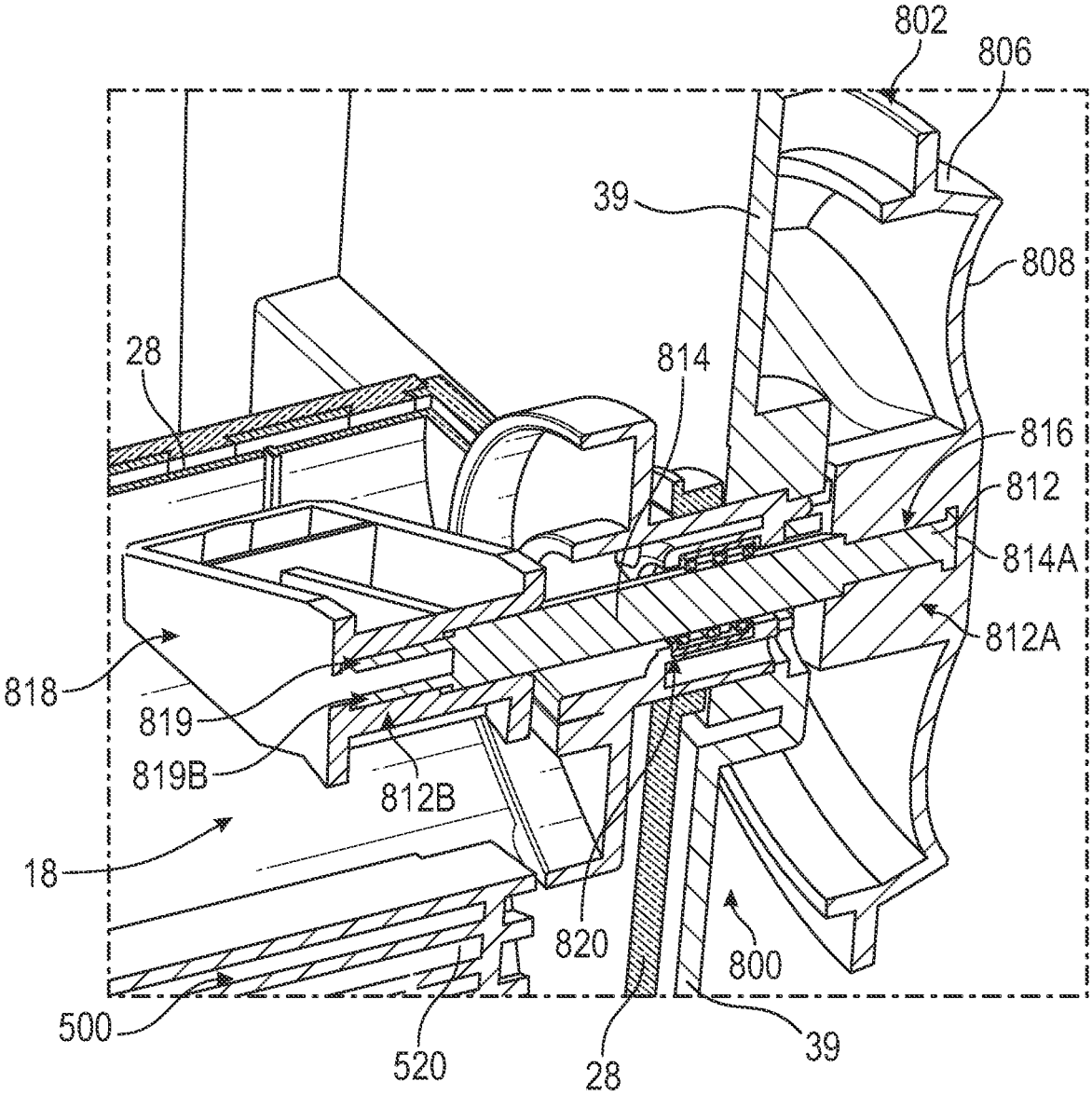
Figure 11C:
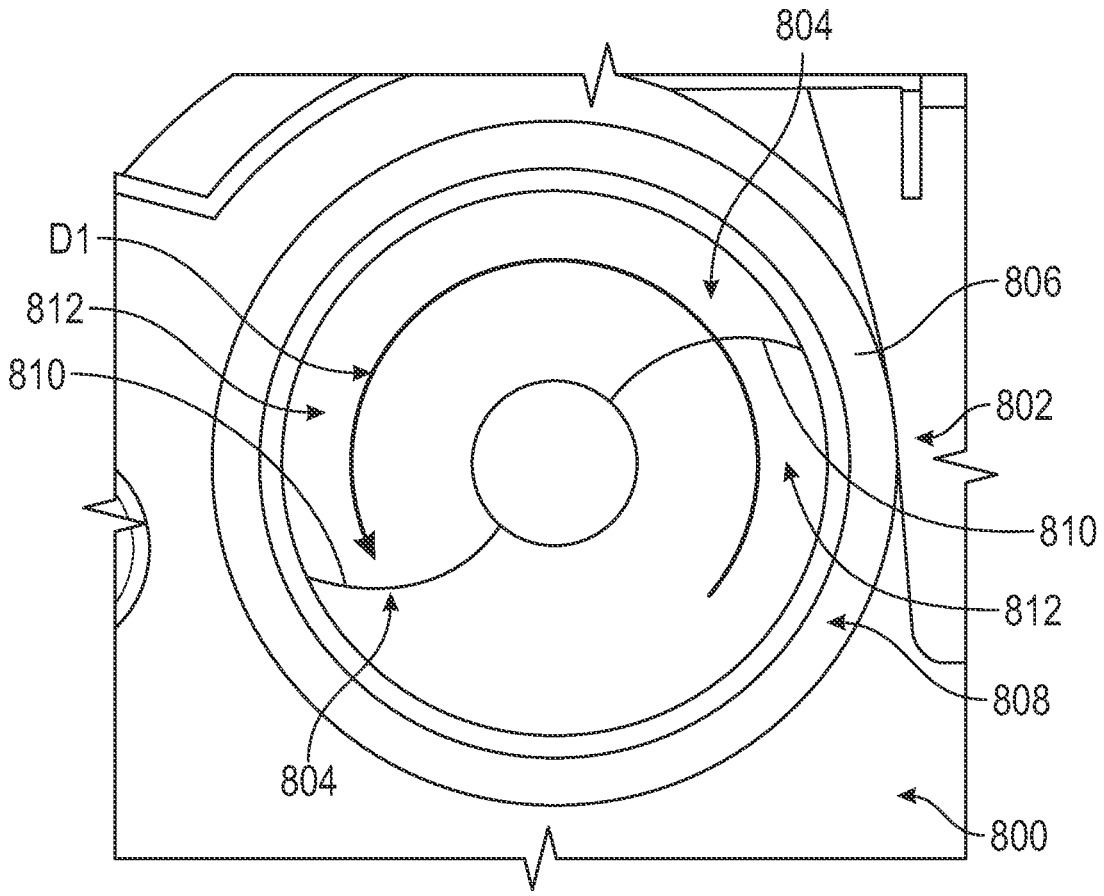

FIGS. 11A-11C, 12A-12D, and 13A-13C show a manual dispensing assembly 800 for a sheet material dispenser 10 according to principles of the present disclosure. As shown in FIGS. 11A-11C, the manual dispensing assembly 800 communicates with feed roller 18 to control movement of the feed roller body 28 to facilitate manual dispensing of selected or desired amounts of sheet material therefrom. In this regard, the manual dispensing assembly 800 is operatively connected to the feed roller body 28 to facilitate manual rotation of the feed roller body 28 by a user. As a result, the feed roller body 28 can be manually rotated by users to initiate rotation of the feed roller to engage and draw the sheet material from the discharge 22 for manual dispensing of the sheet material.

As shown in FIGS. 11A-11C, the manual dispensing assembly 800 includes a user engagement mechanism or portion 802 that is operatively connected to the feed roller body 28 such that engagement or activation of the user engagement mechanism 802 causes rotation of the feed roller body 28 to facilitate dispensing of selected amounts of sheet material from the discharge 22. In embodiments, the engagement mechanism 802 can include a rotatable knob 806, or a lever, handle, or other suitable engagement member or portion, that is operatively connected to the feed roller body 28, such that engagement and rotation of the knob 806 by a user causes rotation of the feed roller body 28 to initiate a dispensing operation (e.g., dispensing of a selected or desired amount of sheet material, such as one or more sheets or preset lengths or amounts of sheet material). The engagement mechanism 802 also can include engagement features 804 that facilitate gripping by users.

In the illustrated example construction, the knob 806 has a body 808 with a substantially circular or disk-like shape (FIGS. 11A-11C). However, other shapes, such as semi-circular, oval, cylindrical, etc. shapes or configurations or combinations thereof, also are possible without departing from the scope of the present disclosure. Furthermore, as shown in FIG. 11C, in some embodiments, the engagement features 804 can include engagement surfaces or areas 810 defined by one or more recesses or contours 812 located along or within the knob body 810. The engagement surfaces 810 can be sized to generally correspond to a hand or digits for a range of potential users (e.g. sized for use by children and/or large adults) so as to have an ergonomic shape or configuration that facilitates ease of rotation of the knob 806 for manual dispensing of the sheet material. The knob body 810 can be formed from plastic or other suitable polymeric materials; though other composite, synthetic, etc. materials or combinations thereof further can be used without departing from the scope of the present disclosure.

FIGS. 11A-11B and 12C-12D also show the manual dispensing assembly 800 having a rotating shaft 812 that connects the engagement mechanism 802 of the sheet material dispenser 10 to the feed roller body 28. For example, one end 812A of the rotating shaft 812 can be connected to the engagement mechanism 802 and an opposite end 812B of the rotating shaft 812 can be connected to the feed roller body 28. In the illustrated construction shown in FIG. 11B, the rotating shaft 812 includes a substantially cylindrical body 814 that can be formed from a plastic or other polymeric material, though other suitable materials, such as metals, wood, other synthetic or composite materials, and/or combinations thereof also can be used without departing from the scope of the present disclosure.

FIG. 11B further shows the one end portion 814A of the shaft body 814 received within a passage or opening 816 defined in the knob body 808. The end portion 814A of the shaft body 814 can be press or frictionally fitted within the passage 816 of the knob body 808 or can be connected thereto by other suitable connection means, e.g., adhesives, fasteners, etc. As a result, the shaft body 814 will be rotatable with rotation of the knob body 808. An opposite or opposing end portion 814B of the shaft body 814 is connected to the feed roller body 28 by a connection or support member 818. For example, the end portion 814B of the shaft body 814 can be received within a passage or opening 819 defined in the connection member 818. The end portion 814B can be press or frictionally fitted within the passage 819 and/or can be fixed therein by a suitable connection means, such as adhesives, fasteners, etc. The connection member 818 also can be fixed to the feed roller body 28, e.g., using fasteners, such as screws, bolts, etc. In this regard, the feed roller body 28 will be rotatable with the rotating shaft 812 and the knob 806, such that the knob 806 can be rotated (e.g., in direction D1 in FIG. 11C) to rotate the feed roller body 28 for manual dispensing of sheet material.

Figure 12A:
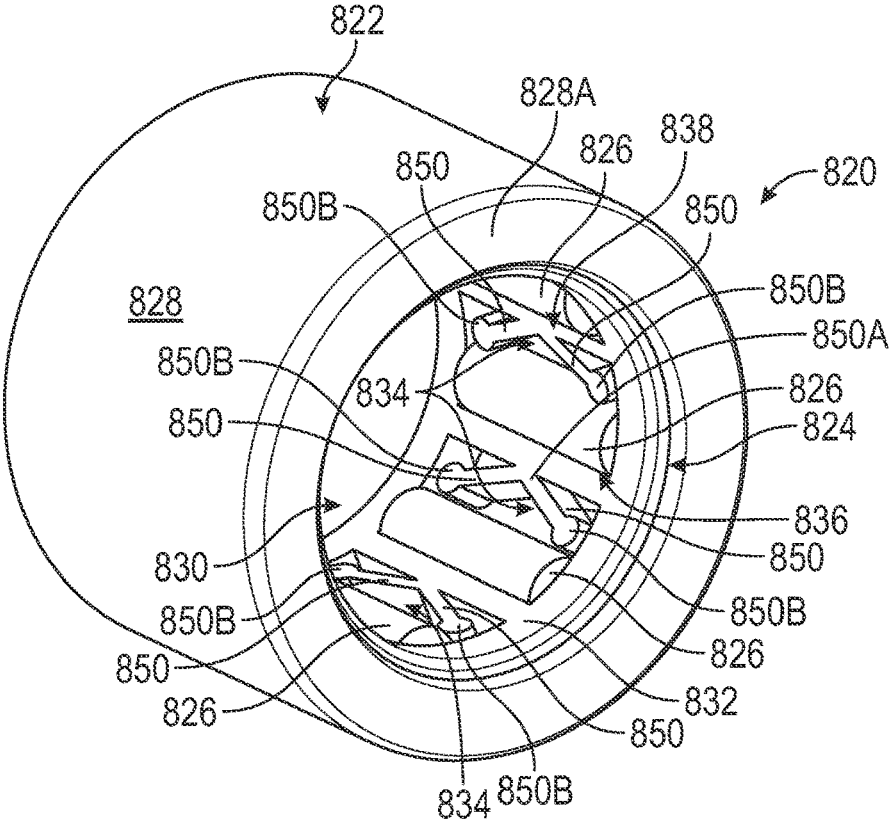
FIGS. 12A, 12B, 12C, and 12D illustrating perspective and side views of an integrated gear clutch for the manual engagement assembly of FIGS. 11A-11C.
Figure 12B:
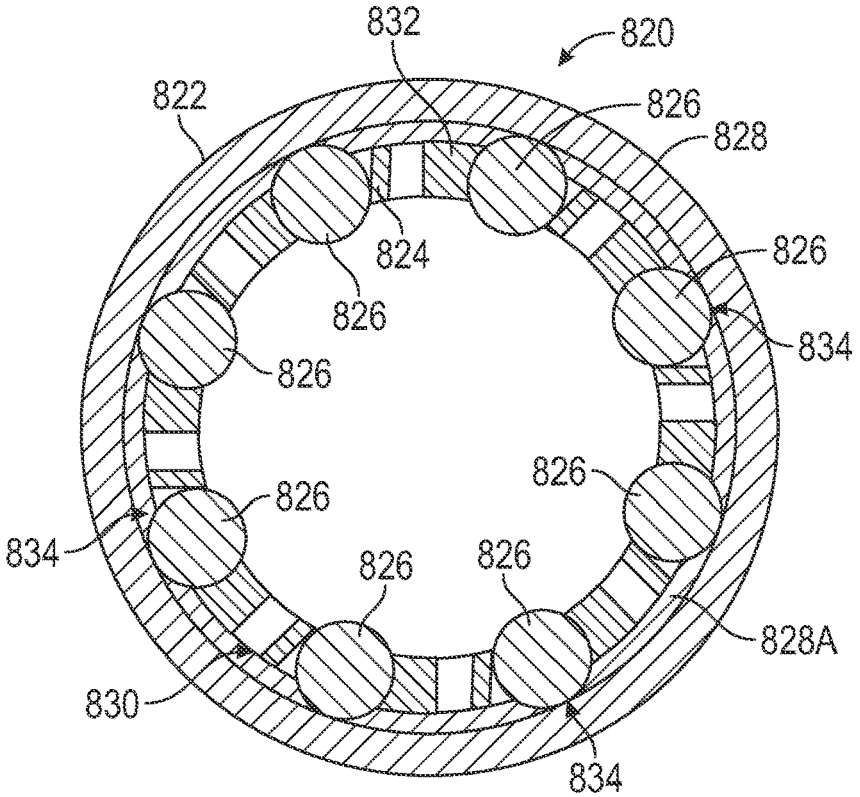
Figure 12C:
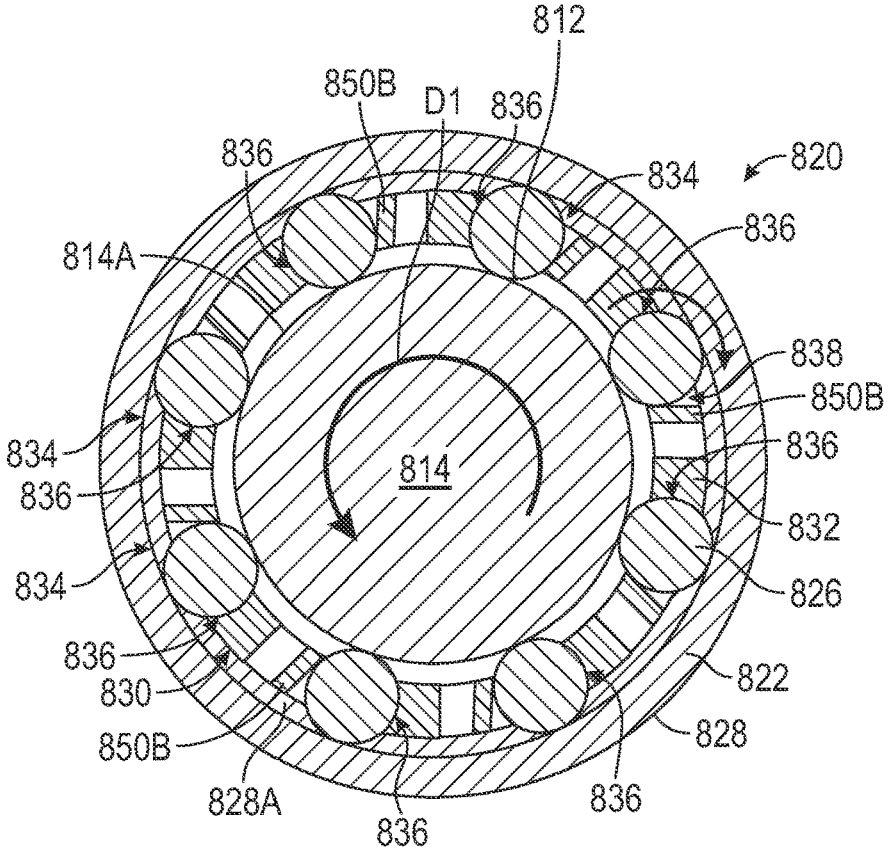
Figure 12D:
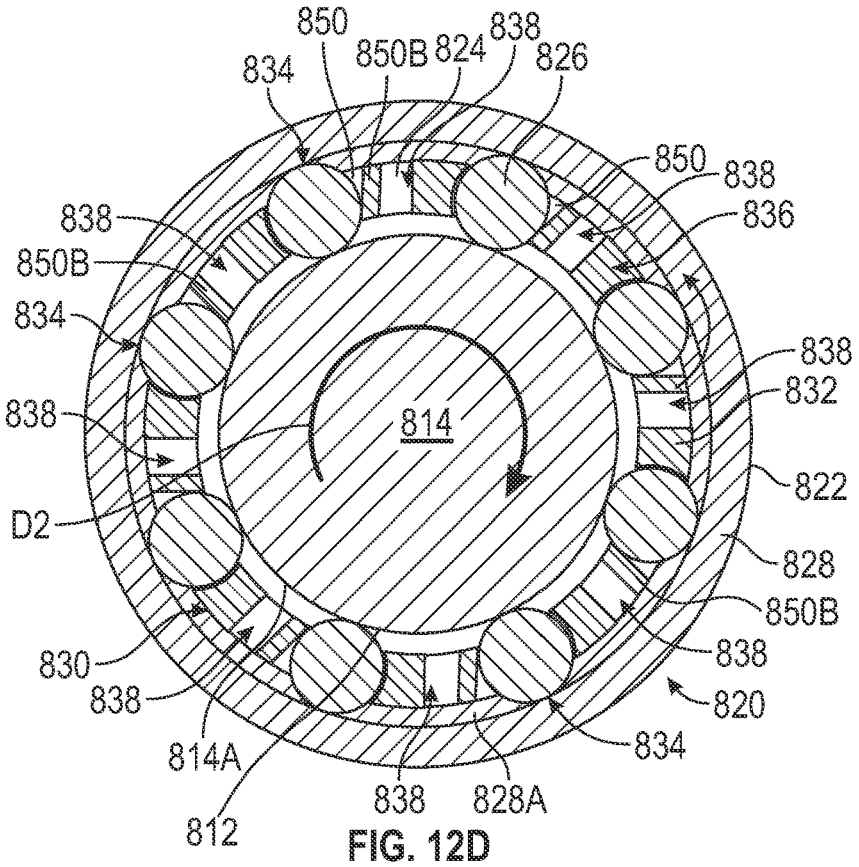

In addition, as FIGS. 11A-11B, 12A-12D, and 13A-13C further indicate, the manual dispensing assembly 800 includes an integrated gear clutch 820 *t* configured to control or limit movement of the user engagement mechanism 802 and/or feed roller 28. As shown in FIGS. 12C and 12D, the integrated gear clutch 820 is provided along and is connected to the rotating shaft 812 and controls movement of the rotating shaft 812 to thus limit or control movement of the engagement mechanism and/or the feed roller body 28. For example, the integrated gear clutch 820 will be configured to permit or allow for movement of the feed roller body 28 and/or the user engagement mechanism 802 when the user engagement mechanism 802 is moved (i.e., rotated), in one direction, e.g., direction D1 in FIG. 11C, but limits, inhibits, or prevents movement of the feed roller body 28 and/or the user engagement mechanism 802 when the user engagement mechanism 802 is attempted to be moved (i.e., rotated), in the opposite direction, e.g., to help to substantially reduce, inhibit, or retard jamming of the sheet material, damage to or malfunctioning of various components of the sheet material dispenser assembly, and/or unnecessary wearing of various components thereof.

FIGS. 12A-12D show various views of the integrated gear clutch 820 according to principles of the present disclosure. As shown in FIGS. 12A-12D, the integrated gear clutch 820 generally includes an outside or outer ring 822, an inner elastic bracket 824, and a plurality of rollers 826. The outside ring 822 generally includes a circular body 828 with a passage or opening 830 that receives the inner elastic bracket 824, such that the outside ring 822 houses or surrounds the inner elastic bracket 824. The body 828 of the outside ring 822 further can include a flange or sidewall 828A that can at least partially engage the inner elastic bracket 824.

The inner elastic bracket 824 further includes a body or frame 832 that engages and/or holds the plurality of rollers 826 in spaced series about the outside ring 822. In the illustrated embodiment, the frame 832 also includes a plurality of openings or apertures 834. These openings 834 are each sized, dimensioned, or otherwise configured to receive a respective roller of the plurality of rollers 826. The frame 832 of the inner elastic bracket 824 also can have a generally circular or ring-like shape that is sized, dimensioned, or otherwise configured to fit within the passage 830 of the outside ring 822. The frame 832 may be generally fixed in relation to the outside ring 822; though the frame 832 may be rotatable thereabout without departing from the scope of the present disclosure.

According to embodiments of the present disclosure, the inner elastic bracket 824 and/or the outer ring 822 can be formed from metallic materials, such as steel, brass, copper, etc., though other materials, such as plastics or other polymeric materials and/or other suitable composite, synthetic, etc. materials, or combinations thereof, can be employed without departing from the scope of the present disclosure. Additionally, a lubricant, such as a bearing grease, oil, etc. or other suitable lubricant, can be received/applied between the inner elastic bracket 824 and the outer ring 822 to help reduce friction and facilitate rotation of the rollers 826.

The rollers 826 can include cylindrical roller bearings, though other suitable roller bearings, e.g., ball bearings, can be used. The rollers 826 can be formed from metallic materials, such as steel, brass, copper, etc.; though the rollers 826 can be formed from plastic materials or polymeric material and/or other synthetic or composite materials or combinations thereof.

FIGS. 12C and 12D further indicate that openings 834 each can define a rotating area 836 along one side thereof and a non-rotating area 838 along an opposing side thereof. The rotating area 836 generally allows for rotation of the rollers 826, while the non-rotating area 838 generally reduces, inhibits, or prevents rotation of the rollers 826. The rollers 826 generally move in relation to their respective openings 834 between engagement with the rotating and non-rotating areas 836 and 838. As a result, when the rotating shaft 812 is rotated in one direction (e.g., in a first direction D1 shown in FIG. 12C), the rollers 826 will engage the rotating area 836 and be able to freely rotate or spin allowing rotation of the rotating shaft 812. Conversely, when the rotating shaft 812 is rotated (or attempted to be rotated) in the opposite direction (e.g., in a second direction D2 in FIG. 12D), the rollers 826 will engage the non-rotating area 838, which engagement that inhibits or substantially prevents rotation of the rollers 826 and thus rotation of the rotating shaft 812.

In a non-limiting, exemplary construction, as shown in FIG. 12A, the non-rotating area 828 can include a plurality of biased prongs or members 850 that are configured to lock or limit rotation of the rollers 826 upon engagement therewith. The biased prongs 850 further can engage and/or support the rollers 286 within their respective openings 834. The biased prongs 850 can include an elongated portion 850A that is connected to the frame 832 and an end portion 850B that engages the rollers 826, e.g., to support or hold the rollers 826 within their respective openings 834 (FIG. 12A). The elongated portion 850A can be angled to facilitate biasing of the prongs 850. In this regard, the biased prongs 850 (e.g., the end portions 850B) thereof can be pressed against the rollers 826 to hold the rollers 826 within the openings 834, and further when the rollers 826 are engaged against the end portions 850B (e.g., due to rotation in direction D2 shown in FIG. 12D), the engaged portions 850B will sufficiently frictionally engage the rollers 826 to limit or prevent rotation thereof.

In addition, the rotating area 836 can include a surface 852 of the inner elastic bracket 824 defined by/along the openings 835. This surface 852 can be curved or otherwise arcuate and can be shaped, sized, or otherwise configured to be generally complementary or correspond to the rollers 826 to allow rotation of the rollers 826 when the rollers 826 are engaged due to rotation in the direction D1 shown in FIG. 12C.

With the integrated gear clutch 820 received about the rotating shaft 812, the rollers 826 can frictionally engage or contact an outer surface 814A of the body 814 of the rotating shaft 82. Accordingly, when the engagement mechanism 802 is rotated in one direction (e.g., in direction D1 shown in FIG. 12C), the rollers 826 will be engaged against the rotating area 836 and are allowed to freely rotate, which thus allows for rotation of the rotating shaft 812 and the feed roller body 28. When the engagement mechanism 802 is rotated in the opposite or opposing direction (e.g., direction D2 in FIG. 12D), however, the rollers 826 generally will engage the non-rotating area 838, causing stopping, limiting, or otherwise inhibiting rotation of the rollers 826 in such direction. The stationary rollers 826 further will frictionally engage the rotating shaft 812 sufficient to prevent rotation thereof, and thus substantially stop rotation of the feed roller body 28. The integrated gear clutch 820 also generally will limit or prevent rotation of the engagement mechanism 802, rotating shaft 812, and feed roller body 28, when a user attempts to rotated the knob 806 in an undesirable direction, (e.g., in a reverse direction such as indicated by direction D2 in FIG. 12D) to help to reduce, inhibit, or prevent jamming of the dispenser assembly and/or damage, malfunctioning, unnecessary wear, etc. of various components of the dispenser assembly.

Figure 13A:
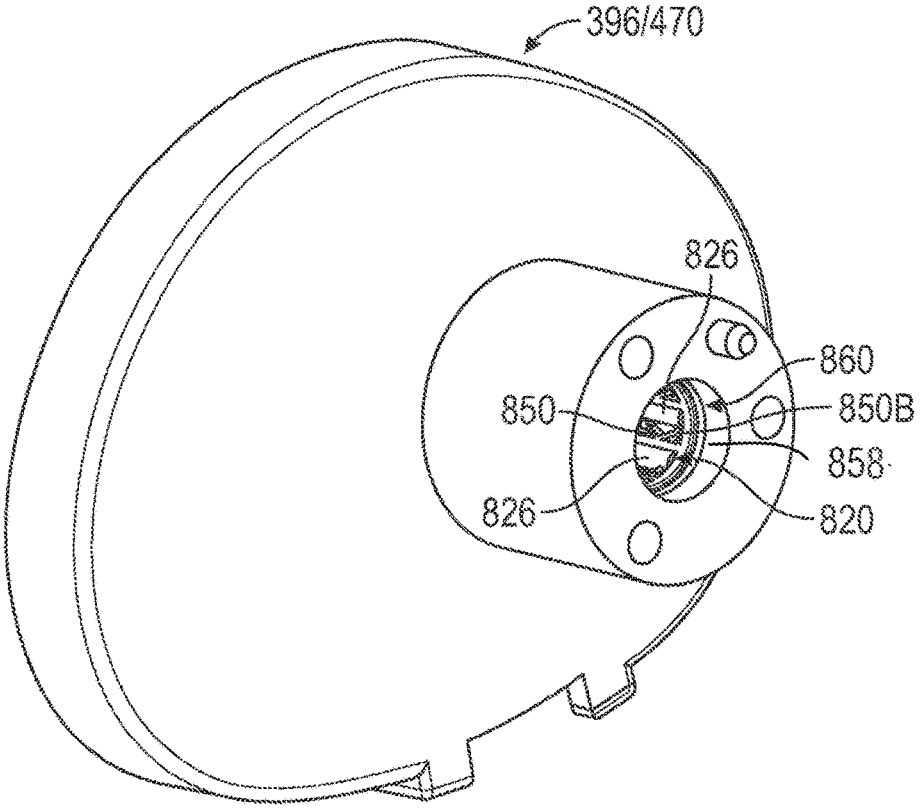
FIGS. 13A, 13B, and 13C show perspective, cross-section, and side views of a single direction bearing assembly with the integrated gear clutch of FIGS. 12A-12D.
Figure 13B:
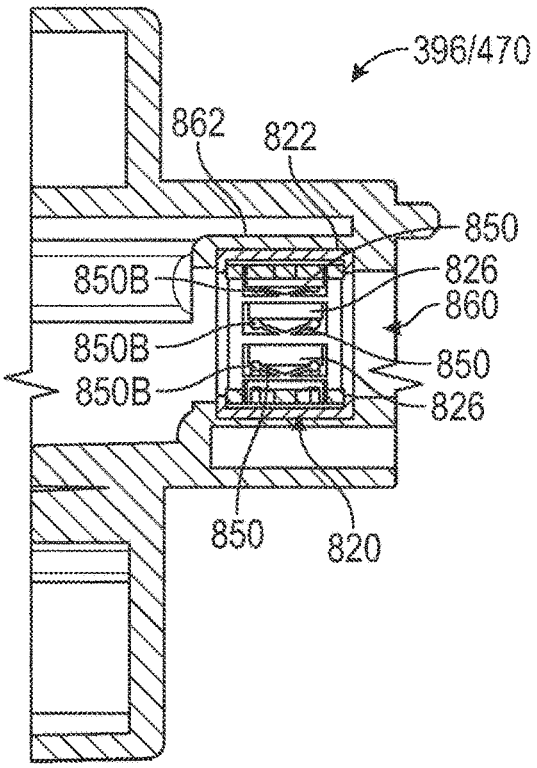
Figure 13C:
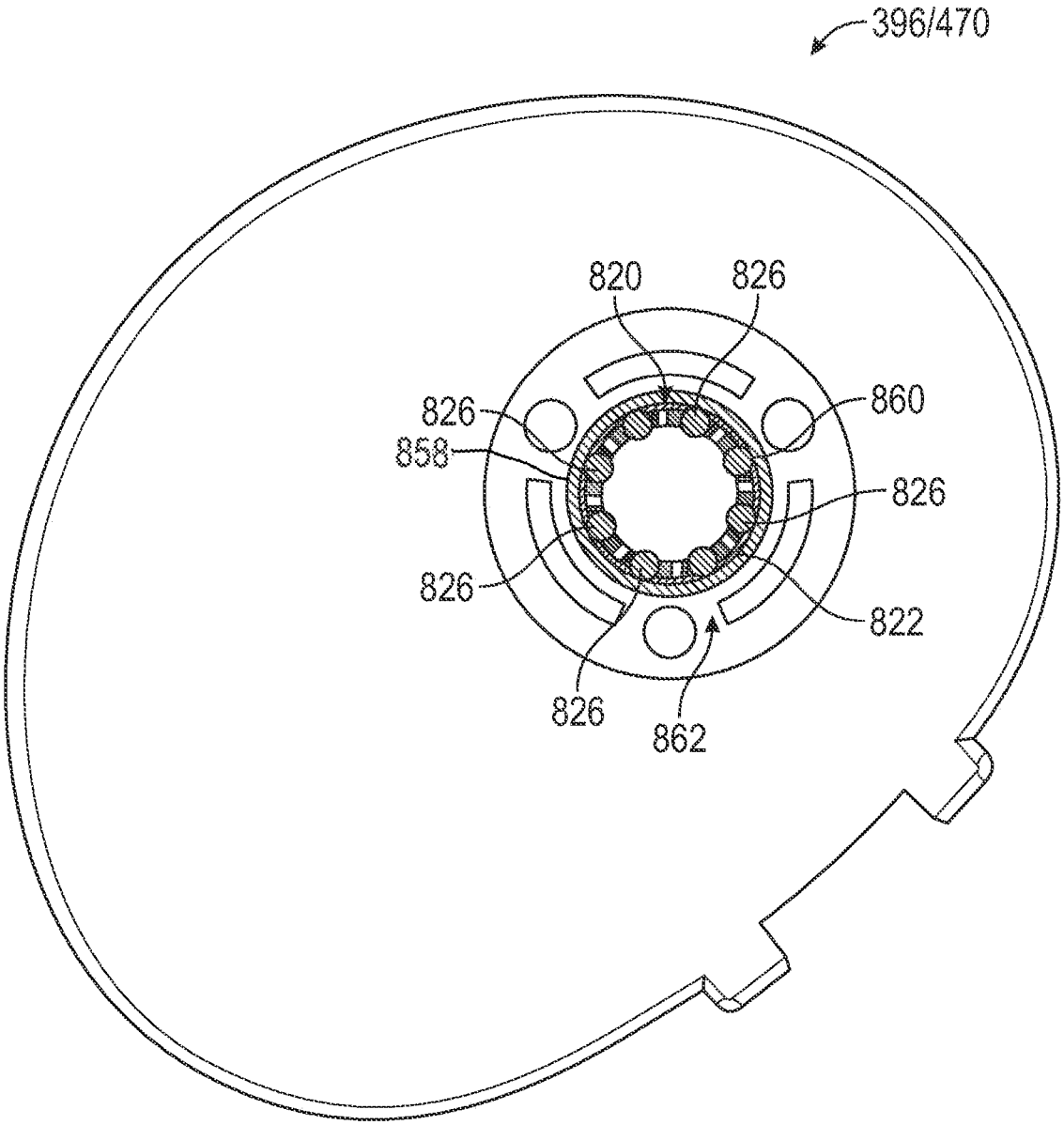

In one non-limiting, exemplary construction, as indicated in FIGS. 13A-13C, the integrated gear clutch 820 can be incorporated with a bearing assembly, e.g., as shown at 396 (FIGS. 4A-4E) or 470 (FIGS. 7A-7B). The bearing assembly 396/470 can include a cylindrical body 858 having a passage or cavity 860 (FIGS. 13A-13C) that receives the integrated gear clutch 820. For example, the outside ring 822 of the integrated gear clutch 820 can be press-fitted or otherwise received within the passage 860, such that the outer ring 822 engages an inner surface 862 defined by the passage 860. In alternative constructions, the integrated gear clutch 820 can be incorporated with the engagement member 802, the connection member 818, or other suitable components of the dispenser.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A dispenser for dispensing sheet material from a supply, comprising:

a dispenser housing including a discharge;

a feed roller rotatably mounted within the dispenser housing, the feed roller having a feed roller body configured to engage and move the sheet material along a discharge path from the supply and toward the discharge, a cylindrical body extending from the feed roller body and having a passage defined therethrough;

a cutting blade and a cam follower operatively connected thereto, wherein the cam follower is configured to move along a cam track to cause movement of the cutting blade into and out from one or more openings defined in the feed roller body, the cam follower being located within an interior cavity of the feed roller body; and a manual dispensing assembly comprising:

an engagement mechanism operatively coupled to the feed roller body, the engagement mechanism comprising a handle configured for engagement by a user to initiate rotation of the feed roller body for dispensing of the sheet material;

a rotating shaft having a first end configured to connect to the engagement mechanism and a second end configured to connect to at least one support member, the at least one support member disposed within the interior cavity of the feed roller body and fixedly connected to an interior surface of the interior cavity of the feed roller body; and an integrated clutch mounted along a side wall of the feed roller body and at least partially located within the passage of the cylindrical body extending from the feed roller body, the integrated clutch configured to receive a portion of the rotating shaft therethrough;

wherein the integrated clutch is configured to support the rotating shaft and allow rotational movement of the rotating shaft in a first direction; and wherein the integrated clutch is configured to selectively frictionally engage an exterior surface of the rotating shaft to permit rotational movement of the feed roller when the engagement mechanism is moved in the first direction and to inhibit rotation of the rotating shaft so as to prevent the rotational movement of the feed roller when movement of the engagement mechanism in a second, opposing direction is attempted.

2. A sheet material dispenser, comprising:

a dispenser housing configured to receive a supply of a sheet material in the dispenser housing, and the dispenser housing having a discharge through which sheets of the sheet material are dispensed;

a feed roller mounted within the dispenser housing and including a feed roller body configured to engage and draw the sheet material from the supply and along a discharge path to the discharge for dispensing;

a cylindrical body extending from the feed roller body and having a passage defined therethrough;

at least one pressing roller rotatably arranged adjacent the feed roller body, the at least one pressing roller configured to urge the sheet material toward engagement with the feed roller body so that the sheet material is fed along the discharge path upon rotation of the feed roller;

a cutting assembly including a cutting blade, the cutting blade configured to move into engagement with the sheet material upon the rotation of the feed roller, the cutting assembly comprising at least one cam follower located within an interior cavity of the feed roller body, and wherein the at least one cam follower is configured to move along a cam track to cause movement of the cutting blade into and out from one or more openings defined in the feed roller body;

a manual dispensing assembly in communication with the feed roller, the manual dispensing assembly comprising:

an engagement portion operatively coupled to the feed roller body, the engagement portion comprising a handle configured to be engaged by a user to cause rotation of the feed roller body;

a rotating shaft having a first end configured to connect to the engagement portion and a second end configured to connect to at least one support member, the at least one support member being disposed within the interior cavity of the feed roller body and fixedly connected to an interior surface of the interior cavity of the feed roller body; and an integrated clutch positioned along a side wall of the feed roller body and between the first and second ends of the rotating shaft, the integrated clutch surrounding and supporting a portion of an exterior surface of the rotating shaft between the first and second ends thereof, wherein the integrated clutch is configured to permit rotational movement of the rotating shaft and allow the rotation of the feed roller for dispensing the sheet material when the engagement portion is moved in one direction and engage and prevent the rotational movement of the rotating shaft so as to stop the rotation of the feed roller when the engagement portion is moved in an opposing direction;

wherein the integrated clutch is located at least partially within the passage of the cylindrical body.

3. The sheet material dispenser of claim 2, further comprising a biasing assembly including one or more biasing members operatively connected to the feed roller body and configured to assist the rotation of the feed roller body or the movement of the cutting blade.

4. The sheet material dispenser of claim 2, wherein the integrated clutch includes an outside ring, an inner elastic bracket, and a plurality of rollers, wherein the outside ring is configured to receive the inner elastic bracket, and wherein the inner elastic bracket includes a plurality of openings defined therein, each of the openings being configured to receive a respective roller of the plurality of rollers.

5. The sheet material dispenser of claim 4, wherein the inner elastic bracket includes a rotating area defined along one side of each of the openings and within which the rollers of the plurality of rollers are allowed to rotate and a non-rotating area along an opposing side of each of the openings, wherein the plurality of rollers are configured to engage with the non-rotating areas to inhibit rotation of the plurality of rollers.

6. The sheet material dispenser of claim 5, wherein each of the non- rotating areas includes one or more biased prongs configured to lock or limit rotation of a respective roller of the plurality of rollers upon engagement of the respective roller with the one or more biased prongs.

7. The sheet material dispenser of claim 1, further comprising a bearing assembly that is connected to the dispenser housing and rotatably supporting the feed roller body, wherein the bearing assembly includes the cylindrical body having the passage within which the integrated clutch is at least partially located.

8. The sheet material dispenser of claim 7, wherein the cutting assembly includes a movable support connected to the cutting blade, wherein the movable support includes the cam follower operatively connected thereto and configured to move along and engage the cam track formed within or along a portion of or connected to the bearing assembly to facilitate the movement of the cutting blade through the one or more openings in the feed roller body.

9. A dispenser for dispensing sheet material from a supply, comprising:

a dispenser housing including a discharge;

a feed roller rotatably mounted within the dispenser housing, the feed roller having a feed roller body configured to engage and move the sheet material along a discharge path from the supply and toward the discharge;

a cylindrical body extending from the feed roller body and having a passage defined therethrough;

a cutting assembly including a cutting blade and a movable support, the movable support being connected to the cutting blade, wherein the movable support includes a cam follower operatively connected thereto and wherein the cam follower is configured to move along a cam track to cause movement of the cutting blade into and out from one or more openings defined in the feed roller body, the cam follower being located within an interior cavity of the feed roller body; and a manual dispensing assembly in communication with the feed roller, the manual dispensing assembly comprising:

an engagement portion operatively coupled to the feed roller body, the engagement portion comprising a handle configured for engagement by a user to initiate rotation of the feed roller body for dispensing of the sheet material;

a rotating shaft projecting through a side wall of the feed roller body and having a first end configured to connect to the engagement portion and a second end disposed-within the interior cavity of the feed roller body and connected to an interior surface of the feed roller body along the interior cavity thereof; and an integrated clutch coupled to the engagement portion;

wherein the integrated clutch is located at least partially within the passage of the cylindrical body and is configured to surround an exterior surface of the rotating shaft and support a portion of the rotating shaft between the first and second ends thereof; and wherein the integrated clutch is configured to selectively allow rotational movement of the rotating shaft to cause movement of the feed roller when the engagement portion is moved in one direction and to frictionally engage the exterior surface of the rotating shaft to prevent rotational movement of the feed roller when movement of the engagement portion in an opposing direction is attempted.

10. The dispenser of claim 9, further comprising one or more pressing rollers rotatably mounted along the feed roller body and configured to engage the sheet material between the one or more pressing rollers and the feed roller body to facilitate feeding of the sheet material along the discharge path upon rotation of the feed roller.

11. The dispenser of claim 9, wherein the integrated clutch includes an outside ring, an inner elastic bracket, and a plurality of rollers, wherein the outside ring is configured to receive the inner elastic bracket, and wherein the inner elastic bracket includes a plurality of openings defined therein, with each of the openings being configured to receive a respective roller of the plurality of rollers, and the inner elastic bracket including a non-rotating area along a side of each of the openings, wherein the plurality of rollers are configured to engage with the non-rotating areas to stop, limit, or inhibit rotation of the plurality of rollers.

12. The dispenser of claim 11, wherein each of the non-rotating areas includes one or more biased prongs configured to lock or limit rotation of a respective roller of the plurality of rollers upon engagement of the respective roller with the one or more biased prongs.

13. The dispenser of claim 9, further comprising a biasing assembly including at least one biasing member, and at least one linkage connected to the at least one biasing member, wherein the at least one linkage is attached to an interior surface of the feed roller body to operatively connect the at least one biasing member to the feed roller body for assisting the rotation of the feed roller body or the movement of the cutting blade.

* * * * *